US009824578B2

(12) United States Patent
Burton et al.

(10) Patent No.: US 9,824,578 B2
(45) Date of Patent: Nov. 21, 2017

(54) HOME AUTOMATION CONTROL USING CONTEXT SENSITIVE MENUS

(71) Applicant: ECHOSTAR UK HOLDINGS LIMITED, Keighley, West Yorkshire (GB)

(72) Inventors: David Burton, Skipton (GB); Martyn Ward, Bingley (GB)

(73) Assignee: EchoStar Technologies International Corporation, Englewood, CO (US)

( * ) Notice: Subject to any disclaimer, the term of this patent is extended or adjusted under 35 U.S.C. 154(b) by 349 days.

(21) Appl. No.: 14/476,377

(22) Filed: Sep. 3, 2014

(65) Prior Publication Data

US 2016/0063854 A1 Mar. 3, 2016

(51) Int. Cl.
*G08C 19/16* (2006.01)
*G08C 17/02* (2006.01)

(52) U.S. Cl.
CPC ..... *G08C 17/02* (2013.01); *G08C 2201/20* (2013.01); *G08C 2201/30* (2013.01); *G08C 2201/71* (2013.01); *G08C 2201/91* (2013.01); *G08C 2201/92* (2013.01); *G08C 2201/93* (2013.01)

(58) Field of Classification Search
CPC ..... G08C 2201/20; G08C 2201/30; G08C 2201/71; G08C 2201/91–2201/93; G08C 17/02
USPC ..... 340/12.5
See application file for complete search history.

(56) References Cited

U.S. PATENT DOCUMENTS

| | | | |
|---|---|---|---|
| 4,127,966 | A | 12/1978 | Schmidt |
| 4,386,436 | A | 5/1983 | Kocher et al. |
| 4,581,606 | A | 4/1986 | Mallory |
| 4,728,949 | A | 3/1988 | Platte et al. |
| 4,959,713 | A | 9/1990 | Morotomi et al. |
| 5,400,246 | A | 3/1995 | Wilson et al. |
| 5,770,896 | A | 6/1998 | Nakajima |
| 5,805,442 | A | 9/1998 | Crater et al. |
| 5,822,012 | A | 10/1998 | Jeon et al. |

(Continued)

FOREIGN PATENT DOCUMENTS

| | | | |
|---|---|---|---|
| CA | 2 267 988 | A1 | 4/1998 |
| CN | 105814555 | A | 7/2016 |

(Continued)

OTHER PUBLICATIONS

U.S. Appl. No. 14/485,188, filed Sep. 12, 2014, Pre-Interview First Office Action mailed Jul. 29, 2015, 20 pages.

(Continued)

*Primary Examiner* — Zhen Y Wu
(74) *Attorney, Agent, or Firm* — Kilpatrick Townsend & Stockton LLP

(57) ABSTRACT

Various arrangements for presenting contextual menus are presented. A mobile device may be configured to provide contextual menus for control or monitoring of components. Different menus and interfaces are presented based the position of the mobile device or objects being pointed at using the mobile device. Specific objects may be designated as control markers. The objects may be recognized using a camera of the mobile device. When a control marker is recognized a specific menu or interface that is associated with the control marker may be presented to the user.

20 Claims, 10 Drawing Sheets

(56) References Cited

U.S. PATENT DOCUMENTS 5,894,331 A 4/1999 Yang
5,926,090 A 7/1999 Taylor et al.
5,970,030 A 10/1999 Dimitri et al.
6,081,758 A 6/2000 Parvulescu
6,104,334 A 8/2000 Allport
6,107,918 A 8/2000 Klein et al.
6,107,935 A 8/2000 Comerford et al.
6,119,088 A 9/2000 Ciluffo
6,182,094 B1 1/2001 Humpleman et al.
6,225,938 B1 * 5/2001 Hayes ..... G11B 15/023 235/462.45
6,286,764 B1 9/2001 Garvey et al.
6,330,621 B1 12/2001 Bakke et al.
6,337,899 B1 1/2002 Alcendor et al.
6,377,858 B1 4/2002 Koeppe
6,405,284 B1 6/2002 Bridge
6,415,257 B1 7/2002 Jungua et al.
6,502,166 B1 12/2002 Cassidy
6,529,230 B1 3/2003 Chong
6,543,051 B1 4/2003 Manson et al.
6,553,375 B1 4/2003 Huang et al.
6,646,676 B1 11/2003 DaGraca et al.
6,662,282 B2 12/2003 Cochran
6,744,771 B1 6/2004 Barber et al.
6,748,343 B2 6/2004 Alexander et al.
6,751,657 B1 6/2004 Zothner
6,756,998 B1 6/2004 Bilger
6,891,838 B1 5/2005 Petite et al.
6,931,104 B1 8/2005 Foster et al.
6,976,187 B2 12/2005 Arnott et al.
6,989,731 B1 1/2006 Kawai et al.
7,009,528 B2 3/2006 Griep
7,010,332 B1 3/2006 Irvin et al.
7,088,238 B2 8/2006 Karaoguz et al.
7,103,545 B2 9/2006 Furuta
7,143,298 B2 11/2006 Wells et al.
7,234,074 B2 6/2007 Cohn et al.
7,260,538 B2 8/2007 Calderone et al.
7,346,917 B2 3/2008 Gatto et al.
7,372,370 B2 5/2008 Stults et al.
7,386,666 B1 6/2008 Beauchamp et al.
7,391,319 B1 6/2008 Walker
7,395,369 B2 7/2008 Sepez et al.
7,395,546 B1 7/2008 Asmussen
7,529,677 B1 5/2009 Wittenberg
7,574,494 B1 8/2009 Mayernick et al.
7,579,945 B1 8/2009 Richter et al.
7,590,703 B2 9/2009 Cashman et al.
7,640,351 B2 12/2009 Reckamp et al.
7,659,814 B2 2/2010 Chen et al.
7,694,005 B2 4/2010 Reckamp et al.
7,739,718 B1 6/2010 Young et al.
7,861,034 B2 12/2010 Yamamoto et al.
7,870,232 B2 1/2011 Reckamp et al.
7,945,297 B2 5/2011 Philipp
7,969,318 B2 6/2011 White et al.
8,013,730 B2 9/2011 Oh et al.
8,086,757 B2 12/2011 Chang
8,106,768 B2 1/2012 Neumann
8,156,368 B2 4/2012 Chambliss et al.
8,171,148 B2 5/2012 Lucas et al.
8,180,735 B2 5/2012 Ansari et al.
8,201,261 B2 6/2012 Barfield et al.
8,221,290 B2 7/2012 Vincent et al.
8,275,143 B2 9/2012 Johnson
8,289,157 B2 10/2012 Patenaude et al.
8,290,545 B2 10/2012 Terlizzi
8,310,335 B2 11/2012 Sivakkolundhu
8,316,413 B2 11/2012 Crabtree
8,320,578 B2 11/2012 Kahn et al.
8,335,312 B2 12/2012 Gerhardt et al.
8,413,204 B2 4/2013 White et al.
8,498,572 B1 7/2013 Schooley et al.
8,516,087 B2 8/2013 Wilson et al.
8,539,567 B1 9/2013 Logue et al.
8,550,368 B2 10/2013 Butler et al.
8,619,136 B2 12/2013 Howarter et al.
8,620,841 B1 12/2013 Filson et al.
8,644,525 B2 2/2014 Bathurst et al.
8,645,327 B2 2/2014 Falkenburg et al.
8,667,529 B2 3/2014 Taxier
8,750,576 B2 6/2014 Huang et al.
8,780,201 B1 7/2014 Scalisi et al.
8,786,698 B2 7/2014 Chen et al.
8,799,413 B2 8/2014 Taylor et al.
8,898,709 B2 11/2014 Crabtree
8,923,823 B1 12/2014 Wilde
8,930,700 B2 1/2015 Wielopolski
8,965,170 B1 2/2015 Benea et al.
9,019,111 B1 4/2015 Sloo et al.
9,049,567 B2 6/2015 Le Guen et al.
9,191,804 B1 11/2015 Paczkowski et al.
9,246,921 B1 1/2016 Vlaminck et al.
9,258,593 B1 2/2016 Chen et al.
9,462,041 B1 10/2016 Hagins et al.
9,495,860 B2 11/2016 Lett
9,511,259 B2 12/2016 Mountain
9,599,981 B2 3/2017 Crabtree
9,621,959 B2 4/2017 Mountain
9,628,286 B1 4/2017 Nguyen et al.
9,632,746 B2 4/2017 Keipert et al.
2001/0012998 A1 8/2001 Jouet et al.
2002/0003493 A1 1/2002 Durst et al.
2002/0019725 A1 2/2002 Petite
2002/0063633 A1 5/2002 Park
2002/0080238 A1 6/2002 Ohmura
2002/0193989 A1 12/2002 Geilhufe et al.
2003/0005431 A1 1/2003 Shinohara
2003/0052789 A1 3/2003 Colmenarez et al.
2003/0097452 A1 5/2003 Kim et al.
2003/0126593 A1 7/2003 Mault
2003/0133551 A1 7/2003 Kahn
2003/0140352 A1 7/2003 Kim
2003/0201900 A1 10/2003 Bachinski et al.
2004/0019489 A1 1/2004 Funk et al.
2004/0036579 A1 2/2004 Megerle
2004/0117038 A1 6/2004 Karaoguz et al.
2004/0117843 A1 6/2004 Karaoguz et al.
2004/0121725 A1 6/2004 Matsui
2004/0128034 A1 7/2004 Lenker et al.
2004/0143838 A1 7/2004 Rose
2004/0148419 A1 7/2004 Chen et al.
2004/0148632 A1 7/2004 Park et al.
2004/0260407 A1 12/2004 Wimsatt
2004/0266419 A1 12/2004 Arling et al.
2005/0038875 A1 2/2005 Park
2005/0049862 A1 3/2005 Choi et al.
2005/0106267 A1 5/2005 Frykman et al.
2005/0159823 A1 * 7/2005 Hayes ..... G05B 15/02 700/19
2005/0188315 A1 8/2005 Campbell et al.
2005/0200478 A1 9/2005 Koch et al.
2005/0245292 A1 11/2005 Bennett et al.
2005/0264698 A1 12/2005 Eshleman
2005/0289614 A1 12/2005 Baek et al.
2006/0011145 A1 1/2006 Kates
2006/0087428 A1 4/2006 Wolfe et al.
2006/0136968 A1 6/2006 Han et al.
2006/0143679 A1 6/2006 Yamada et al.
2006/0155389 A1 7/2006 Pessolano et al.
2006/0244624 A1 11/2006 Wang et al.
2006/0253894 A1 11/2006 Bookman et al.
2007/0044119 A1 2/2007 Sullivan et al.
2007/0078910 A1 4/2007 Bopardikar
2007/0129220 A1 6/2007 Bardha
2007/0135225 A1 6/2007 Nieminen et al.
2007/0142022 A1 6/2007 Madonna et al.
2007/0146545 A1 6/2007 Iwahashi
2007/0157258 A1 7/2007 Jung et al.
2007/0192486 A1 8/2007 Wilson et al.
2007/0194922 A1 8/2007 Nathan et al.
2007/0256085 A1 11/2007 Reckamp et al.
2007/0271518 A1 11/2007 Tischer et al.
2007/0275670 A1 11/2007 Chen et al.

(56) References Cited

U.S. PATENT DOCUMENTS

2007/0279244 A1* 12/2007 Haughawout ..... G08C 19/28 340/4.31
2008/0019392 A1 1/2008 Lee
2008/0021971 A1 1/2008 Halgas
2008/0022322 A1 1/2008 Grannan et al.
2008/0046930 A1 2/2008 Smith et al.
2008/0062258 A1 3/2008 Bentkovski et al.
2008/0062965 A1 3/2008 Silva et al.
2008/0092199 A1 4/2008 McCarthy et al.
2008/0109095 A1 5/2008 Braithwaite et al.
2008/0114963 A1 5/2008 Cannon et al.
2008/0120639 A1 5/2008 Walter et al.
2008/0123825 A1 5/2008 Abramson et al.
2008/0140736 A1 6/2008 Jarno
2008/0144884 A1 6/2008 Habibi
2008/0163330 A1 7/2008 Sparrell
2008/0278635 A1 11/2008 Hardacker et al.
2008/0284905 A1 11/2008 Chuang
2008/0288876 A1 11/2008 Fleming
2008/0297660 A1 12/2008 Shioya
2009/0023554 A1 1/2009 Shim
2009/0027225 A1 1/2009 Farley
2009/0069038 A1 3/2009 Olague et al.
2009/0083374 A1 3/2009 Saint Clair
2009/0112541 A1 4/2009 Anderson et al.
2009/0138507 A1 5/2009 Burckart et al.
2009/0146834 A1 6/2009 Huang
2009/0165069 A1 6/2009 Kirchner
2009/0167555 A1 7/2009 Kohanek
2009/0190040 A1 7/2009 Watanabe et al.
2009/0235992 A1 9/2009 Armstrong
2009/0249428 A1 10/2009 White et al.
2009/0270065 A1 10/2009 Hamada et al.
2009/0271203 A1 10/2009 Resch et al.
2009/0307715 A1 12/2009 Santamaria et al.
2010/0031286 A1 2/2010 Gupta et al.
2010/0045471 A1 2/2010 Meyers
2010/0046918 A1 2/2010 Takao et al.
2010/0083371 A1 4/2010 Bennetts et al.
2010/0097225 A1 4/2010 Petricoin, Jr.
2010/0122284 A1 5/2010 Yoon et al.
2010/0131280 A1 5/2010 Bogineni
2010/0138007 A1 6/2010 Clark et al.
2010/0138858 A1 6/2010 Velazquez et al.
2010/0146445 A1 6/2010 Kraut
2010/0164732 A1 7/2010 Wedig et al.
2010/0211546 A1 8/2010 Grohman et al.
2010/0283579 A1 11/2010 Kraus et al.
2010/0309004 A1 12/2010 Grundler et al.
2010/0321151 A1 12/2010 Matsuura et al.
2011/0018693 A1* 1/2011 Lim ..... G08C 19/28 340/12.5
2011/0030016 A1 2/2011 Pino et al.
2011/0032423 A1 2/2011 Jing et al.
2011/0093126 A1 4/2011 Toba et al.
2011/0119325 A1 5/2011 Paul et al.
2011/0140832 A1 6/2011 Vinkenvleugel et al.
2011/0150432 A1 6/2011 Paul et al.
2011/0156862 A1 6/2011 Langer
2011/0167250 A1 7/2011 Dicks et al.
2011/0187928 A1 8/2011 Crabtree
2011/0187930 A1 8/2011 Crabtree
2011/0187931 A1 8/2011 Kim
2011/0202956 A1 8/2011 Connelly et al.
2011/0270549 A1 11/2011 Jeansonne et al.
2011/0282837 A1 11/2011 Gounares et al.
2011/0283311 A1 11/2011 Luong
2011/0285528 A1 11/2011 Weinstein et al.
2011/0295396 A1 12/2011 Chinen et al.
2012/0019388 A1 1/2012 Kates et al.
2012/0047083 A1 2/2012 Qiao et al.
2012/0047532 A1 2/2012 McCarthy
2012/0059495 A1 3/2012 Weiss et al.
2012/0069246 A1 3/2012 Thornberry et al.
2012/0094696 A1 4/2012 Ahn et al.
2012/0105724 A1 5/2012 Candelore
2012/0124245 A1* 5/2012 Reeves ..... G05B 19/0426 710/8
2012/0124456 A1 5/2012 Perez et al.
2012/0154108 A1* 6/2012 Sugaya ..... G06F 9/4443 340/5.1
2012/0154138 A1 6/2012 Cohn et al.
2012/0164975 A1 6/2012 Dodeja et al.
2012/0226768 A1 9/2012 Gaines et al.
2012/0271472 A1 10/2012 Brunner et al.
2012/0271670 A1 10/2012 Zaloom
2012/0280802 A1 11/2012 Yoshida et al.
2012/0291068 A1 11/2012 Khushoo et al.
2012/0314713 A1 12/2012 Singh et al.
2012/0316876 A1 12/2012 Jang et al.
2012/0326835 A1 12/2012 Cockrell et al.
2013/0006400 A1 1/2013 Caceres et al.
2013/0031037 A1 1/2013 Brandt et al.
2013/0046800 A1 2/2013 Assi et al.
2013/0049950 A1 2/2013 Wohlert
2013/0053063 A1 2/2013 McSheffrey
2013/0060358 A1 3/2013 Li et al.
2013/0070044 A1 3/2013 Naidoo et al.
2013/0074061 A1 3/2013 Averbuch et al.
2013/0090213 A1 4/2013 Amini et al.
2013/0120137 A1 5/2013 Lehmann
2013/0124192 A1 5/2013 Lindmark et al.
2013/0138757 A1 5/2013 Ferron
2013/0147604 A1 6/2013 Jones et al.
2013/0152139 A1 6/2013 Davis et al.
2013/0185750 A1 7/2013 Ayoub
2013/0204408 A1 8/2013 Thiruvengada et al.
2013/0219482 A1 8/2013 Brandt
2013/0238326 A1 9/2013 Kim et al.
2013/0247117 A1* 9/2013 Yamada ..... G08C 17/02 725/93
2013/0267383 A1 10/2013 Watterson
2013/0278828 A1 10/2013 Todd
2013/0300576 A1 11/2013 Sinsuan et al.
2013/0318559 A1 11/2013 Crabtree
2013/0321637 A1 12/2013 Frank et al.
2013/0324247 A1 12/2013 Esaki et al.
2014/0025798 A1 1/2014 Apte et al.
2014/0028546 A1 1/2014 Jeon et al.
2014/0095684 A1 4/2014 Nonaka et al.
2014/0101465 A1 4/2014 Wang et al.
2014/0142724 A1 5/2014 Park et al.
2014/0160360 A1 6/2014 Hsu et al.
2014/0167969 A1 6/2014 Wedig et al.
2014/0168277 A1 6/2014 Ashley et al.
2014/0192197 A1 7/2014 Hanko et al.
2014/0192997 A1 7/2014 Niu et al.
2014/0201315 A1 7/2014 Jacob et al.
2014/0215505 A1 7/2014 Balasubramanian et al.
2014/0218517 A1 8/2014 Kim et al.
2014/0223548 A1 8/2014 Wassingbo
2014/0266669 A1 9/2014 Fadell et al.
2014/0266684 A1 9/2014 Poder et al.
2014/0282653 A1 9/2014 Ariantaj et al.
2014/0310075 A1 10/2014 Ricci
2014/0313014 A1 10/2014 Huh et al.
2014/0333529 A1 11/2014 Kim et al.
2014/0351832 A1 11/2014 Cho et al.
2014/0362201 A1 12/2014 Nguyen et al.
2014/0373074 A1 12/2014 Hwang et al.
2015/0008846 A1 1/2015 Chen et al.
2015/0015401 A1 1/2015 Wedig et al.
2015/0029096 A1 1/2015 Ishihara
2015/0054910 A1 2/2015 Offen et al.
2015/0061859 A1 3/2015 Matsuoka et al.
2015/0066173 A1 3/2015 Ellis et al.
2015/0074259 A1 3/2015 Ansari et al.
2015/0082225 A1 3/2015 Shearer
2015/0084770 A1 3/2015 Xiao et al.
2015/0085184 A1* 3/2015 Vidal ..... H04N 5/2252 348/376
2015/0097689 A1 4/2015 Logue et al.
2015/0100167 A1 4/2015 Sloo et al.
2015/0106866 A1 4/2015 Fujita

(56) References Cited

U.S. PATENT DOCUMENTS

| | | | |
|---|---|---|---|
| 2015/0113571 | A1 | 4/2015 | Cholas et al. |
| 2015/0127712 | A1 | 5/2015 | Fadell et al. |
| 2015/0137967 | A1 | 5/2015 | Wedig et al. |
| 2015/0142991 | A1 | 5/2015 | Zaloom |
| 2015/0143406 | A1 | 5/2015 | Cho et al. |
| 2015/0143408 | A1 | 5/2015 | Sallas |
| 2015/0145643 | A1 | 5/2015 | Fadell et al. |
| 2015/0154850 | A1 | 6/2015 | Fadell et al. |
| 2015/0156030 | A1 | 6/2015 | Fadell et al. |
| 2015/0156612 | A1 | 6/2015 | Vemulapalli |
| 2015/0159401 | A1 | 6/2015 | Patrick et al. |
| 2015/0160623 | A1 | 6/2015 | Holley |
| 2015/0160634 | A1 | 6/2015 | Smith et al. |
| 2015/0160635 | A1 | 6/2015 | Schofield et al. |
| 2015/0160636 | A1 | 6/2015 | McCarthy et al. |
| 2015/0160663 | A1 | 6/2015 | McCarthy et al. |
| 2015/0160935 | A1 | 6/2015 | Nye |
| 2015/0161452 | A1 | 6/2015 | McCarthy et al. |
| 2015/0161882 | A1 | 6/2015 | Lett |
| 2015/0162006 | A1 | 6/2015 | Kummer |
| 2015/0163411 | A1 | 6/2015 | McCarthy, III et al. |
| 2015/0163412 | A1 | 6/2015 | Holley et al. |
| 2015/0163535 | A1 | 6/2015 | McCarthy et al. |
| 2015/0172742 | A1 | 6/2015 | Richardson |
| 2015/0192914 | A1 | 7/2015 | Slupik |
| 2015/0198941 | A1 | 7/2015 | Pederson |
| 2015/0241860 | A1 | 8/2015 | Raid |
| 2015/0281824 | A1 | 10/2015 | Nguyen et al. |
| 2015/0309487 | A1 | 10/2015 | Lyman |
| 2015/0341599 | A1 | 11/2015 | Carey |
| 2015/0347910 | A1 | 12/2015 | Fadell et al. |
| 2015/0365787 | A1 | 12/2015 | Farrell |
| 2016/0029153 | A1 | 1/2016 | Linn et al. |
| 2016/0066046 | A1 | 3/2016 | Mountain |
| 2016/0091471 | A1 | 3/2016 | Benn |
| 2016/0098309 | A1 | 4/2016 | Kim |
| 2016/0100696 | A1 | 4/2016 | Palashewski et al. |
| 2016/0109864 | A1 | 4/2016 | Lonn |
| 2016/0121161 | A1 | 5/2016 | Mountain |
| 2016/0123741 | A1 | 5/2016 | Mountain |
| 2016/0163168 | A1 | 6/2016 | Brav et al. |
| 2016/0182249 | A1 | 6/2016 | Lea |
| 2016/0191912 | A1 | 6/2016 | Lea et al. |
| 2016/0191990 | A1 | 6/2016 | McCarthy |
| 2016/0203700 | A1 | 7/2016 | Bruhn et al. |
| 2016/0234034 | A1 | 8/2016 | Mahar et al. |
| 2016/0256485 | A1 | 9/2016 | Wager et al. |
| 2016/0260135 | A1 | 9/2016 | Zomet et al. |
| 2016/0286327 | A1 | 9/2016 | Marten |
| 2016/0323548 | A1 | 11/2016 | Khot et al. |
| 2016/0334811 | A1 | 11/2016 | Marten |
| 2016/0335423 | A1 | 11/2016 | Beals |
| 2016/0338179 | A1 | 11/2016 | Aliakseyeu et al. |
| 2016/0342379 | A1 | 11/2016 | Keipert et al. |
| 2016/0366746 | A1 | 12/2016 | van de Ven et al. |
| 2017/0005822 | A1 | 1/2017 | Gao |
| 2017/0065433 | A1 | 1/2017 | Gould et al. |
| 2017/0041886 | A1 | 2/2017 | Baker et al. |
| 2017/0048476 | A1 | 2/2017 | Freiin von Kapri et al. |
| 2017/0054615 | A1 | 2/2017 | Wilson |

FOREIGN PATENT DOCUMENTS

| | | | |
|---|---|---|---|
| EP | 2 736 027 | A1 | 5/2014 |
| EP | 3 080 677 | A1 | 10/2016 |
| EP | 3 080 710 | A1 | 10/2016 |
| GB | 2 304 952 | A | 3/1997 |
| JP | 2008148016 | A | 6/2008 |
| WO | 93/20544 | A1 | 10/1993 |
| WO | 2004/068386 | A1 | 8/2004 |
| WO | 2011/095567 | A1 | 8/2011 |
| WO | 2014/068556 | A1 | 5/2014 |
| WO | 2015/179120 | A1 | 11/2015 |
| WO | 2016/034880 | A1 | 3/2016 |
| WO | 2016/066399 | A1 | 5/2016 |
| WO | 2016/066442 | A1 | 5/2016 |
| WO | 2016/182696 | A1 | 11/2016 |

OTHER PUBLICATIONS

U.S. Appl. No. 14/485,188, filed Sep. 12, 2014, Pre-Interview First Office Action mailed Oct. 1, 2015, 10 pages.

U.S. Appl. No. 14/470,352, filed Aug. 27, 2014 Non Final Office Action mailed Aug. 26, 2016, all pages.

U.S. Appl. No. 14/715,248, filed May 18, 2015, Non-Final Rejection mailed Jul. 19, 2016, 34 pages.

U.S. Appl. No. 14/107,132, filed Dec. 16, 2013, Non Final Office Action mailed Jul. 18, 2016, all pages.

U.S. Appl. No. 14/567,783, filed Dec. 11, 2014, Non Final Rejection mailed Aug. 23, 2016, all pages.

Mexican Institute of Industrial Property Office Action dated Nov. 1, 2013, for Mex. Patent Appln No. MX/a/2012/008882 is not translated into English, 3 pages.

Mexican Institute of Industrial Property Notice of Allowance dated Feb. 10, 2014, for Mex. Patent Appln No. MX/a/2012/008882, 1 page.

Wang et al., "Mixed Sound Event Verification on Wireless Sensor Network for Home Automation," IEEE Transactions on Industrial Informatics, vol. 10, No. 1, Feb. 2014, 10 pages.

U.S. Appl. No. 12/700,310, filed Feb. 4, 2010 Non-Final Office Action mailed Mar. 11, 2015, 35 pages.

U.S. Appl. No. 14/107,132, filed Dec. 16, 2013, Non Final Office Action mailed May 27, 2015, 26 pages.

"Acoustic/Ultrasound Ultrasonic Flowmeter Basics," Questex Media Group LLC, accessed on Dec. 16, 2014, 4 pages. Retrieved from http://www.sensorsmag.com/sensors/acoustic-ultrasound/ultrasonic-flowmeter-basics-842.

"AllJoyn Onboarding Service Frameworks," Qualcomm Connected Experiences, Inc., ac cessed on Jul. 15, 2014, 9 pages. Retrieved from https://www.alljoyn.org.

"App for Samsung Smart TV®," Crestron Electronics, Inc., accessed on Jul. 14, 2014, 3 pages. Retrieved from http://www.crestron.com/products/smart tv television apps/.

"Do you want to know how to find water leaks? Use a Bravedo Water Alert Flow Monitor to find out!", Bravedo.com, accessed Dec. 16, 2014, 10 pages. Retrieved from http://bravedo.com/.

"Flow Pulse®, Non-invasive clamp-on flow monitor for pipes," Pulsar Process Measurement Ltd, accessed on Dec. 16, 2014, 2 pages. Retrieved from http://www.pulsar-pm.com/product-types/flow/flow-pulse.aspx.

"International Building Code Excerpts, Updated with recent code changes that impact electromagnetic locks," Securitron, Assa Abloy, IBC/IFC 2007 Supplement and 2009, "Finally-some relief and clarification", 2 pages. Retrieved from: www.securitron.com/Other/.../New_IBC-IFC_Code_Language.pdf.

"Introduction to Ultrasonic Doppler Flowmeters," OMEGA Engineering inc., accessed on Dec. 16, 2014, 3 pages. Retrieved from http://www.omega.com/prodinfo/ultrasonicflowmeters.html.

"Ultrasonic Flow Meters," RS Hydro Ltd, accessed on Dec. 16, 2014, 3 pages. Retrieved from http://www.rshydro.co.uk/ultrasonic-flowmeter.shtml.

"Voice Activated TV using the Amulet Remote for Media Center," AmuletDevices.com, accessed on Jul. 14, 2014, 1 page. Retrieved from http://www.amuletdevices.com/index.php/Features/television.html.

International Search Report and Written Opinion of PCT/EP2011/051608 mailed on May 30, 2011, 13 pages.

International Preliminary Report on Patentability for PCT/EP2011/051608 mailed Aug. 16, 2012, 8 pages.

International Search Report and Written Opinion of PCT/US2014/053876 mailed Nov. 26, 2014, 8 pages.

International Search Report and Written Opinion of PCT/US2014/055441 mailed Dec. 4, 2014, 10 pages.

International Search Report and Written Opinion for PCT/US2014/055476 mailed Dec. 30, 2014, 10 pages.

(56) References Cited

OTHER PUBLICATIONS

Lamonica, M., "CES 2010 Preview: Green comes in many colors," retrieved from CNET.com (http://ces.cnet.com/8301-31045_1-10420381-269.html), Dec. 22, 2009, 2 pages.
The Office Action dated Dec. 16, 2013 for Mexican Patent Application No. MX/a/2012/008882 is not translated into English, 3 pages.
Robbins, Gordon, Deputy Chief, "Addison Fire Department Access Control Installation," 2006 International Fire Code, Section 1008. 1.3.4, 4 pages.
U.S. Appl. No. 12/700,310, filed Feb. 4, 2010 Non-Final Office Action mailed Aug. 14, 2014, 18 pages.
U.S. Appl. No. 12/700,310, filed Feb. 4, 2010 Final Office Action mailed Feb. 28, 2014, 17 pages.
U.S. Appl. No. 12/700,310, filed Feb. 4, 2010 Non-Final Office Action mailed Oct. 15, 2013, 15 pages.
U.S. Appl. No. 12/700,310, filed Feb. 4, 2010 Non-Final Office Action mailed Apr. 1, 2013, 16 pages.
U.S. Appl. No. 12/700,310, filed Feb. 4, 2010, Final Office Action mailed Oct. 10, 2012, 16 pages.
U.S. Appl. No. 12/700,310, filed Feb. 4, 2010, Office Action mailed May 4, 2012, 15 pages.
U.S. Appl. No. 12/700,408, filed Feb. 4, 2010, Notice of Allowance mailed Jul. 28, 2012, 8 pages.
U.S. Appl. No. 13/680,934, filed Nov. 19, 2012, Notice of Allowance mailed Jul. 25, 2014, 12 pages.
U.S. Appl. No. 13/680,934, filed Nov. 19, 2012,Notice of Allowance mailed Apr. 30, 2014, 9 pages.
U.S. Appl. No. 13/680,934, filed Nov. 19, 2012,Final Office Action mailed Feb. 10, 2014, 13 pages.
U.S. Appl. No. 13/680,934, filed Nov. 19, 2012,Non-Final Office Action mailed Oct. 2, 2013, 7 pages.
International Search Report and Written Opinion for PCT/US2016/028126 mailed Jun. 3, 2016, all pages.
U.S. Appl. No. 12/700,310, filed Feb. 4, 2010 Non-Final Office Action mailed Jun. 16, 2016, 30 pages.
U.S. Appl. No. 14/528,739, filed Oct. 30, 2014 Notice of Allowance mailed Jun. 23, 2016, 34 pages.
U.S. Appl. No. 14/485,188, filed Sep. 12, 2014, Non-Final Rejection mailed Jun. 17, 2016, 29 pages.
U.S. Appl. No. 14/710,331, filed May 12, 2015, Non-Final Rejection mailed May 20, 2016, 42 pages.
International Preliminary Report on Patentability for PCT/US2014/055441 issued Jun. 14, 2016, 8 pages.
International Preliminary Report on Patentability for PCT/US2014/053876 issued Jun. 14, 2016, 7 pages.
International Preliminary Report on Patentability for PCT/US2014/055476 issued Jun. 14, 2016, 9 pages.
International Search Report and Written Opinion for PCT/EP2015/073299 mailed Jan. 4, 2016, 12 pages.
International Search Report and Written Opinion for PCT/EP2015/073936 mailed Feb. 4, 2016, all pages.
U.S. Appl. No. 14/485,188, filed Sep. 12, 2014, Final Rejection mailed Feb. 23, 2016, 22 pages.
U.S. Appl. No. 14/567,348, filed Dec. 11, 2014, Preinterview first office action mailed Jan. 20, 2016, 23 pages.
Fong A.C.M. et al, "Indoor air quality control for asthma patients using smart home technology," Consumer Electronics (ISCE), 2011 IEEE 15th International Symposium On, IEEE, Jun. 14, 2011, pp. 18-19, XP032007803, DOI: 10.1109/ISCE.2011.5973774, ISBN: 978-1-61284-8433, Abstract and sections 3 and 4.
Shunfeng Cheng et al., "A Wireless Sensor System for Prognostics and Health Management," IEEE Sensors Journal, IEEE Service Center, New York, NY, US, vol. 10, No. 4, Apr. 1, 2010, pp. 856-862, XP011304455, ISSN: 1530-437X, Sections 2 and 3.
International Search Report and Written Opinion for PCT/EP2015/070286 mailed Nov. 5, 2015, 13 pages.
International Search Report and Written Opinion for PCT/GB2015/052544 mailed Nov. 6, 2015, 10 pages.
U.S. Appl. No. 14/470,352, filed Aug. 27, 2014 Non Final Office Action mailed Nov. 20, 2015, 28 pages.
International Search Report and Written Opinion for PCT/GB2015/052457 mailed Nov. 13, 2015, 11 pages.
U.S. Appl. No. 12/700,310, filed Feb. 4, 2010 Final Office Action mailed Oct. 26, 2015, 19 pages.
U.S. Appl. No. 14/107,132, filed Dec. 16, 2013, Final Rejection mailed Dec. 16, 2015, 32 pages.
U.S. Appl. No. 14/470,352, filed Aug. 27, 2014 Final Office Action mailed Mar. 17, 2016, all pages.
U.S. Appl. No. 14/567,765, filed Dec. 11, 2014, Preinterview first office action mailed Apr. 8, 2016, 30 pages.
U.S. Appl. No. 14/577,717, filed Dec. 19, 2014, Preinterview first office action mailed Apr. 4, 2016, 29 pages.
U.S. Appl. No. 14/584,075, filed Dec. 29, 2014, Non-Final Rejection mailed Apr. 1, 2016, 40 pages.
International Preliminary Report on Patentability for PCT/GB2015/052544 issued Mar. 7, 2017, all pages.
International Search Report and Written Opinion for PCT/US2016/057729 mailed Mar. 28, 2017, all pages.
European Search Report for EP 16 20 0422 dated Jan. 13, 2017, all pages.
BDEJONG_CREE, "Cannot remove last user of a group even though members still exist," Microsoft Visual Studio forum site, Topic ID #58405, Response by Microsoft, Dec. 17, 2010) retrieved on Apr. 6, 2017 from: https://connect.microsoft.com/VisualStudio/feedback/details/580405/tfs-2010-cannont-remove-last-user-of-a-group-even-though-members-still-exists.
International Preliminary Report on Patentability for PCT/GB2015/052457 issued Feb. 28, 2017, all pages.
U.S. Appl. No. 14/567,765, filed Dec. 11, 2014, Final Rejection mailed Feb. 16, 2017, all pages.
U.S. Appl. No. 14/485,038, filed Sep. 12, 2014, Non Final Rejection mailed Apr. 6, 2017, all pages.
U.S. Appl. No. 14/584,075, filed Dec. 29, 2014, Non-Final Rejection mailed Mar. 10, 2017, all pages.
U.S. Appl. No. 14/710,331, filed May 12, 2015, Non-Final Rejection mailed Mar. 10, 2017, all pages.
U.S. Appl. No. 14/566,977, filed Dec. 11, 2014, Final Rejection mailed Feb. 10, 2017, all pages.
U.S. Appl. No. 14/671,299, filed Mar. 27, 2015, Notice of Allowance mailed Apr. 17, 2017, all pages.
U.S. Appl. No. 14/565,853, filed Dec. 10, 2014, Non Final Rejection mailed Mar. 10, 2017, all pages.
U.S. Appl. No. 15/075,412, filed Mar. 21, 2016, Final Rejection mailed Apr. 17, 2017, all pages.
U.S. Appl. No. 14/497,130, filed Sep. 25, 2014, Non Final Rejection mailed Feb. 8, 2017, all pages.
U.S. Appl. No. 14/528,402, filed Oct. 30, 2014, Non-Final Rejection mailed Apr. 11, 2017, all pages.
U.S. Appl. No. 14/475,252, filed Sep. 2, 2014, Non-Final Rejection mailed Apr. 12, 2017, all pages.
U.S. Appl. No. 14/485,188, filed Sep. 12, 2014, Non-Final Rejection mailed Apr. 19, 2017, all pages.
U.S. Appl. No. 12/700,310, filed Feb. 4, 2010 Notice of Allowance mailed Nov. 8, 2016, all pages.
U.S. Appl. No. 14/567,765, filed Dec. 11, 2014, First Action interview mailed Oct. 18, 2016, all pages.
U.S. Appl. No. 14/584,075, filed Dec. 29, 2014, Final Rejection mailed Oct. 6, 2016, all pages.
U.S. Appl. No. 14/566,977, filed Dec. 11, 2014, Non Final Rejection mailed Oct. 3, 2016, all pages.
U.S. Appl. No. 14/567,754, filed Dec. 11, 2014, Non Final Rejection mailed Nov. 4, 2016, all pages.
U.S. Appl. No. 14/567,770, filed Dec. 11, 2014, Non Final Rejection mailed Nov. 4, 2016, all pages.
U.S. Appl. No. 14/671,299, filed Mar. 27, 2015, Non Final Rejection mailed Oct. 28, 2016, all pages.
Office Action for EP14868928.4 dated Sep. 23, 2016, all pages.
U.S. Appl. No. 14/470,352, filed Aug. 27, 2014 Notice of Allowance mailed Dec. 2, 2016, all pages.
U.S. Appl. No. 15/050,958, filed Feb. 23, 2016 Notice of Allowance mailed Dec. 6, 2016, all pages.

(56) References Cited

OTHER PUBLICATIONS

U.S. Appl. No. 15/289,395, filed Oct. 10, 2016 Non-Final Rejection mailed Dec. 2, 2016, all pages.
U.S. Appl. No. 14/107,132, filed Dec. 16, 2013, Notice of Allowance mailed Jan. 18, 2017, all pages.
U.S. Appl. No. 14/485,188, filed Sep. 12, 2014, Final Rejection mailed Nov. 25, 2016, 22 pages.
U.S. Appl. No. 14/577,717, filed Dec. 19, 2014, Final Office Action mailed Dec. 19, 2016, all pages.
U.S. Appl. No. 14/567,783, filed Dec. 11, 2014, Final Rejection mailed Dec. 20, 2016, all pages.
U.S. Appl. No. 15/075,412, filed Mar. 21, 2016, Non Final Rejection mailed Dec. 21, 2016, all pages.
Notification of Publication of European Application No. 162004220 as EP 3166308 on May 10, 2017, 2 pages.
U.S. Appl. No. 14/832,821, filed Aug. 21, 2015, Non-Final Rejection dated Apr. 24, 2017, all pages.
U.S. Appl. No. 14/981,501, filed Dec. 28, 2015, Preinterview first office action dated Apr. 20, 2017, all pages.

* cited by examiner

HOME AUTOMATION CONTROL USING CONTEXT SENSITIVE MENUS

BACKGROUND

Control and monitoring systems for homes are typically designed for a limited and specific control or monitoring function. The systems are often difficult to manage and configure and rely on proprietary non-intuitive interfaces and/or keypads. Users wishing to deploy different control and monitoring tasks in their home are forced to deploy multiple inoperable systems each designed for a specific task and each with a separate control and configuration interface. Improved home control and monitoring systems are needed.

SUMMARY

In embodiments, a method for automation control using a mobile device is presented. The method includes the steps of determining a relative position of the mobile device in relation to a designated house-hold object. Based at least in part on the relative position of the mobile device, determining if the mobile device is pointing at the designated house-hold object. The method further includes the steps of providing an indication that the mobile device is pointing at the designated house-hold object, determining a component associated with the designated house-hold object, and providing a user interface on the mobile device for interacting with the component associated with the designated house-hold object. In embodiments the user interface includes features specific to the component.

In embodiments, the method may further include the steps of establishing a communication channel with the component, receiving, via the communication channel, data related to a state of the component, and transmitting, via the communication channel, a control command to the component. In some embodiments the steps may also include determining a change in the relative position of the mobile device, determining if the mobile device is pointing at a second designated house-hold object associated with a second component, and modifying the user interface on the mobile device for interacting with the second component associated with the second designated house-hold object. In some embodiments the position may include an orientation and a location of the mobile device. In some cases the designated house-hold object may be selected from a group consisting of a computer readable image, a home automation component, and a location in a home. The method may also include capturing an image from a camera of the mobile device and analyzing the image to identify the designated house-hold object. In some embodiments determining the relative position of the mobile device may include the steps of receiving data from a sensor attached to the mobile device and tracking movement of the mobile device by analyzing changes in data from the sensor.

In some embodiments, a non-transitory processor-readable medium for automation control using a mobile device is presented. The medium may include processor-readable instructions configured to cause one or more processors to determine a relative position of the mobile device in relation to a designated house-hold object. Based at least in part on the relative position of the mobile device, determine if the mobile device is pointing at the designated house-hold object. In embodiments the medium may include instruction configured to cause one or more processors to provide an indication that the mobile device is pointing at the designated house-hold object, determine a component associated with the designated house-hold object, and provide a user interface on the mobile device for interacting with the component associated with the designated house-hold object. In some embodiments, the user interface includes features specific to the component.

In some embodiments, a mobile device configured for automation control is presented. The mobile device may include one or more processors and a memory communicatively coupled with and readable by the one or more processors and having stored therein processor-readable instructions which, when executed by the one or more processors, cause the one or more processors to determine a relative position of the mobile device in relation to a designated house-hold object. Based at least in part on the relative position of the mobile device, the mobile device may determine if the mobile device is pointing at the designated house-hold object. In embodiments, the instructions which, when executed by the one or more processors, may cause the one or more processor to also provide an indication that the mobile device is pointing at the designated house-hold object, determine a component associated with the designated house-hold object, and provide a user interface on the mobile device for interacting with the component associated with the designated house-hold object. In embodiments the user interface may include features specific to the component.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
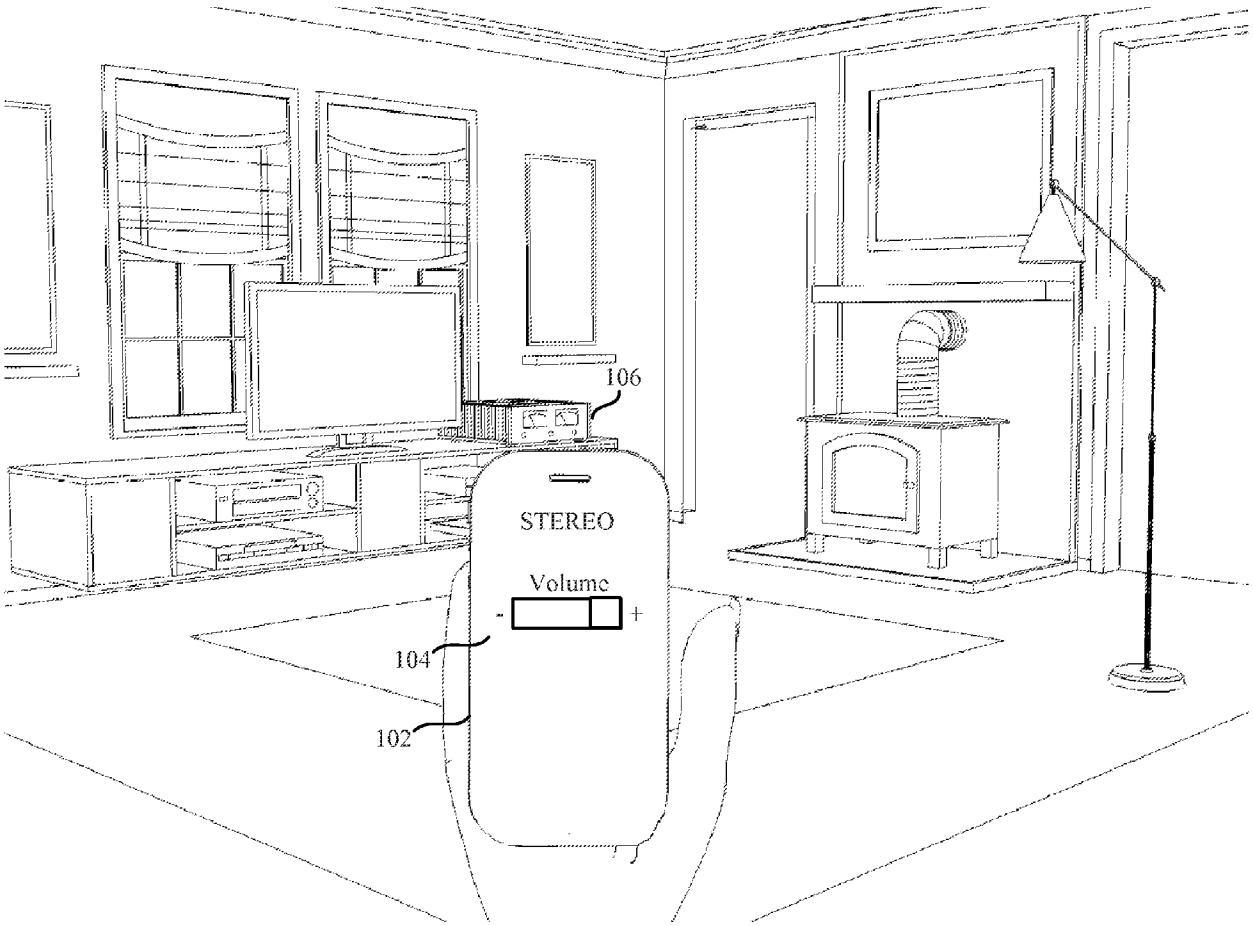
FIGS. 1A and 1B illustrate embodiments of a control interface in a home environment.

Components of a home automation system may be controlled using a mobile device such as a remote control, mobile phone, or tablet computer. A mobile device may be configured to provide an interface for control or monitoring for the components of a home automation system. An interface on a mobile device may allow a user to receive the status of a component or adjust the operating parameters of the component. A mobile device may be configured to send and receive data to components of a home automation system.

A mobile device may be configured to control or monitor various components or aspects of a home automation system. A mobile device, for example, may be configured to communicate with a thermostat of a home and adjust the temperature of a home. The same device may be configured to monitor or view video images of a security camera installed in a home. Further still, the same mobile device may also be used to determine the status of a smoke alarm or to control the position of window blinds.

The control of each component or function of a home automation system may require a different user interface and control characteristics such as control protocols, communication protocols, authorization, and the like. A user interface and/or control characteristics may be automatically selected by the mobile device when the device is in proximity of a component of the home automation system. In some embodiments, a user interface and/or control characteristics may be automatically selected by the mobile device when the mobile device is pointed at a control marker associated with a component of the system.

A mobile device may be configured to detect when the mobile device is being pointed at a home automation component. A mobile device may be configured to detect one or more control markers. The control markers may be associated with one or more components of a home automation system. When a control marker is detected by the mobile device, the mobile device may be configured to provide a user interface on the mobile device that allows a user to view data received from the component or control aspects of the component.

A control markers may include a variety of images, signals, or objects that may be detected and identified by a mobile device. In some embodiments, a control marker may be a specific position or gesture of a mobile device. A control marker may be detected by a sensor of the mobile device. Control markers may be detected using accelerometers, cameras, microphones, or other sensors of a mobile device.

In one example, a mobile device may be configured to capture images or video from a camera of a mobile device. Images may be analyzed to recognize objects designated as control markers. Objects my household objects that are associated to components of a home automation system. When a house hold item that is designated as a control marker is detected in an image captured by a camera, the mobile device may determine the component that is associated with the control marker. The mobile device may determine the capabilities, restrictions, communication protocols, and the like of the component and may provide an interface for interacting with the component. The mobile device may receive and/or transmit data to the component.

For example, FIG. 1A shows an embodiment with a mobile device. The mobile device 102 may be a handheld smart phone for example. The mobile device 102 may include a front facing camera. The camera may be used to scan or take images and/or video of the surroundings or areas that the user is pointing the mobile device at. When a user points the camera of the mobile device 102 at an area of a home, the mobile device may analyze the images captured by the camera to determine if there are any control markers in the field of view of the camera. The mobile device may be configured or trained by the user to detect specific objects designated as control markers. In some cases, the mobile device may be preprogrammed to detect or recognize specific patterns, objects, logos, or other items. In the example of FIG. 1A, a stereo 106 may be a control marker. The mobile device 102 may be configured to recognize the shape of the stereo 106. The mobile device may use image recognition algorithms and software to identify patterns of the image that match the shape and characteristics of the stereo 106.

When a control object is detected, the mobile device may determine which component of a home automation system is associated with the control marker. The association between a control marker and a component may be defined by a user. The mobile device may store a table or other data structures that associates control markers with components. The table may include definitions and characteristics of the components that may include the capabilities of the components, authorization requirements, communication protocols, user interface specifications, and the like. When a control marker is detected the mobile device may use the table to determine the associated component and the characteristics of the component. In this example, the control marker may be associated with the home audio system of the home. The mobile device may include information about the characteristics of the home audio system. The characteristics may include how to connect to the home audio system, which protocols are necessary, the capabilities, the user interface to present to the user, and the like. The characteristics of the home audio system may be loaded by the mobile device and the user interface 104 on the mobile device 102 may be displayed for controlling the home audio system. Controls on the interface may include controls for changing the volume, for example. When the user changes the setting of the control, the mobile device may transmit a command to the home audio system to adjust the volume.

Figure 1B:
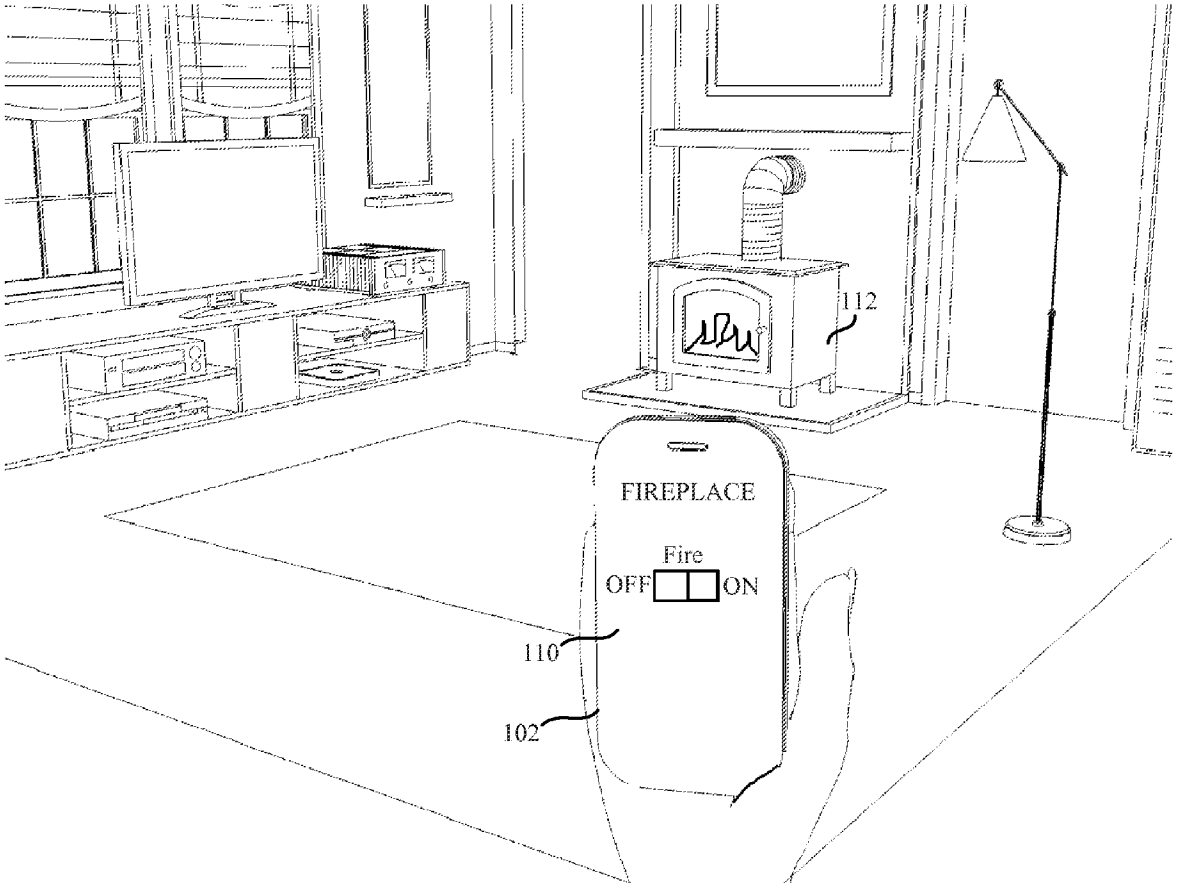

The mobile device may be configured to detect or recognize many different control markers and automatically, upon detection of a control marker, provide a user interface for the component associated with the control marker. For example, as shown in FIG. 1B, when the mobile device 102 is pointed at a different location of the home another control marker may be detected. The mobile device may be configured to detect the image of a fireplace 112. The fireplace may be a control marker associated with the gas heater of the home. When the fireplace 112 control marker is detected by the camera, the mobile device 102 may identify the characteristics of the gas heater and provide to the user an interface 110 on the mobile device 102 for controlling the gas heater. The interface may, for example allow the user to turn the gas heater on or off.

A user may therefore control or interact with many different components of a home automation system by pointing a mobile device at control markers. Detection of control markers may cause the mobile device to automatically determine the capabilities and characteristics of the component and provide a user with an interface for the components. A user does not have to navigate menus or search for components and interfaces to control or interact with components. Pointing a mobile device at control markers may automatically provide the necessary interfaces.

Users may design or modify custom control interfaces for components. User may select the operations, actions, buttons, colors, images, skins, layout, fonts, notifications, and the like for the interfaces for the components. In some cases users may limit or arrange the user interface to show a subset of a the data or controls associated with a component. For example, a stereo system may include functions related to controlling the audio properties such as the bass, treble, and equalizer functions. The stereo may have functions for selecting of scanning radio stations, changing discs, navigating to internet locations. A user however, may only choose a subset of the functions for an interface. A user may select functions and controls for adjusting the volume of the stereo and turning the stereo ON or OFF. A design application or interface may be provided to a user allowing the user to select a subset of features and controls for each component and adjust other characteristics of the interface.

In some embodiments user may save their interface designs and share with other users. User designs for interfaces for components may be uploaded to a service provided, a cloud, a repository, or the like. Other users may be able to download and use the interface designs for interfaces for components.

In the examples of FIGS. 1A and 1B, the control markers (stereo 106, fireplace 112) are also the components of the home automation system. In many cases the control marker may be a different object than the component. For example, a control marker such as a window of a home may be associated with the heating and cooling components of the home. In another example, a picture or a barcode on a wall may be associated with the home security system.

In some cases, control markers may be in a different part of the home and may be seemingly unrelated to the component or device the control marker is associated with. Users may designate virtually an object, location, or gesture of a component. A camera facing down towards the a control marker in a corner of the room, for example, may be associated with components in a different room or location. In embodiments control markers may be spread around a room to allow mapping and multiple markers could be used to locate or may be associated with one component or device.

In some embodiments, the mobile device may automatically associate specific control markers such as logos or patterns with specific components. The mobile device may include a database or other data structure that identifies specific manufacturer logos, patterns, or the like with components. When a specific manufacturer logo is detected, the mobile device may be configured to automatically determine the component associated with the logo and provide a user interface for interacting with the component.

Figure 2:
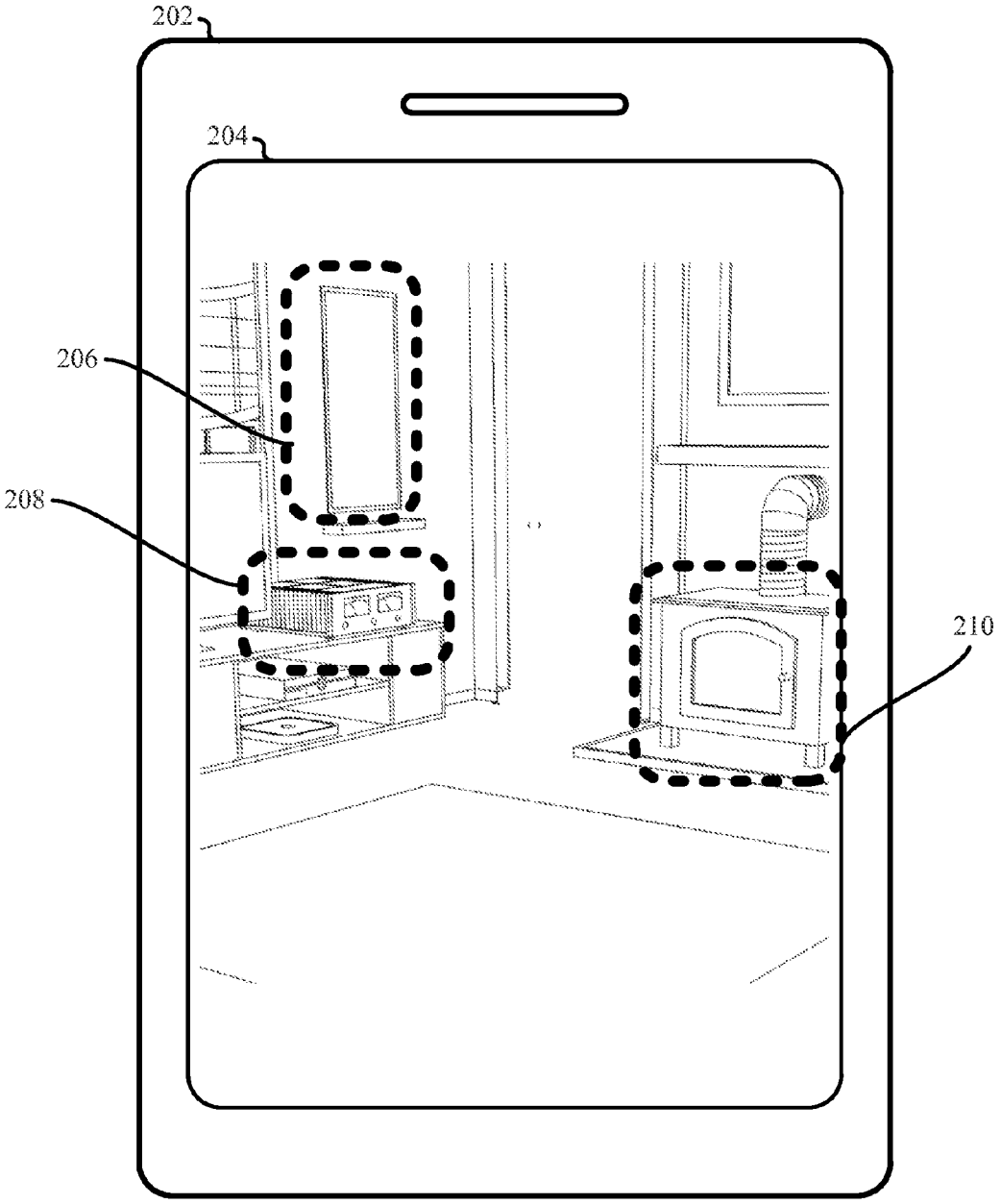
FIG. 2 illustrates an interface for detecting control markers using a mobile device.

In some cases, the mobile device may be configured to provide an indication when a control marker is detected. In some cases more than one control marker may be in the field of view of the camera of the mobile device or control markers may be in close proximity making it difficult to determine which control marker the mobile device is pointing at. The mobile device may provide an interface that may provide an indication when a control marker is detected and allow the user to select one of the control markers. For example FIG. 2 shows one embodiment of an interface for identifying and/or detecting control markers using a mobile device. A mobile device 202 that uses a camera may display on the screen of the device an image or real time video of the images captured by the camera. Control markers that are detected in the images may be highlighted or outlined. As shown in FIG. 2, for example, three control markers are within the field of view of the camera of the mobile device 202. The three control markers that include the stereo 208, fireplace 210, and the window 206 may be highlighted. In some cases an option identification describing the functionality or component associated with the control marker may be displayed. Text or icon may be displayed next to each highlighted control marker that is indicative of their functionality.

The interface on the mobile device may be configured to allow a user to select or acknowledge a control marker. Upon selection of an identified control marker, the mobile device may present an interface specific for the component associated with the control marker. The control marker indication may be used by a user to discover controllable components in their home. A mobile device may be used to scan an area to discover control markers.

In some embodiments, when more than one control marker is in the field of view of the camera of the mobile device, the mobile device may provide an indication of the control markers. Users may select one of the control markers by focusing on one specific control marker. A user may select one of the control markers by positioning the mobile device towards the desired control marker. For example, in the case of a mobile device with a camera, a control marker may be selected by a user by positioning the mobile device such that the desired control marker is in the center of the field of view of the camera. After predefined time period, say two or three seconds, the control marker in the center of the field of view of the camera may be automatically selected and the user interface for the control marker may be displayed to the user.

In some configurations, the mobile device may be "trained" by a user to detect or recognize control markers. The trained control marker may then be associated with a component. A user may use a mobile device to capture and identify images of items or areas in a home. The mobile device may store the images or analyze the images to create templates that may be used to identify the control marker in subsequent images.

Components in a home automation system may advertise themselves, their capabilities, and/or their associated control markers to mobile devices. Mobile devices may use a discovery mode or other procedures to detect nearby or available components. The components may provide to the mobile device their characteristics, control interfaces, and or control marker templates and definitions that may be used to detected the control markers.

In embodiments, detection of control markers may be based only on the analysis of images captured by a mobile device. In some cases the detection of control markers may be supplemented with position information. Position information may include the location and/or the orientation of the mobile device. Position information may be determined from sensors of the mobile device such as GPS sensors, accelerometers, or gyroscopes. In some cases, position information may be external sensors or detectors and transmitted to the mobile device. Sensors in a home, for example, may detect the presence of the mobile device and track the location of the device through the home. The position data may be transmitted to the device. Position information may be used to narrow down or filter the number of possible control marker definitions that are used in the analysis of an image captured by the camera of the mobile device. For example, a mobile device may be determined to be located in a bedroom of a home. Based on the position, the control markers that are known to be located in the kitchen or the living room of a home may be ignored and only control marker definitions that are known to be located in the bedroom may be a analyzed.

In some embodiments the location of control markers may be based only on the position information. A control marker may be the specific position of a mobile device. Based on the position (location and/or orientation), the location or control marker within the home the mobile device is pointing at can be determined.

In some embodiments, markers or objects may be used to aid in navigation or location detection. Location markers may not be associated with components or devices but may be associated with predefined locations. Location markers may be detected by sensors, such as a camera, of the mobile device. The detection of location marker may provide an indication to the mobile device as to the location of the mobile device. Control markers may be identified relative to the location markers. Location markers may in some cases also be control markers. A mobile device may map a location such as a room by using location and control markers. A map of the room with locations of the control and location markers may provide location feedback to the mobile device as the mobile device is moved and repositioned around the room.

Figure 3:
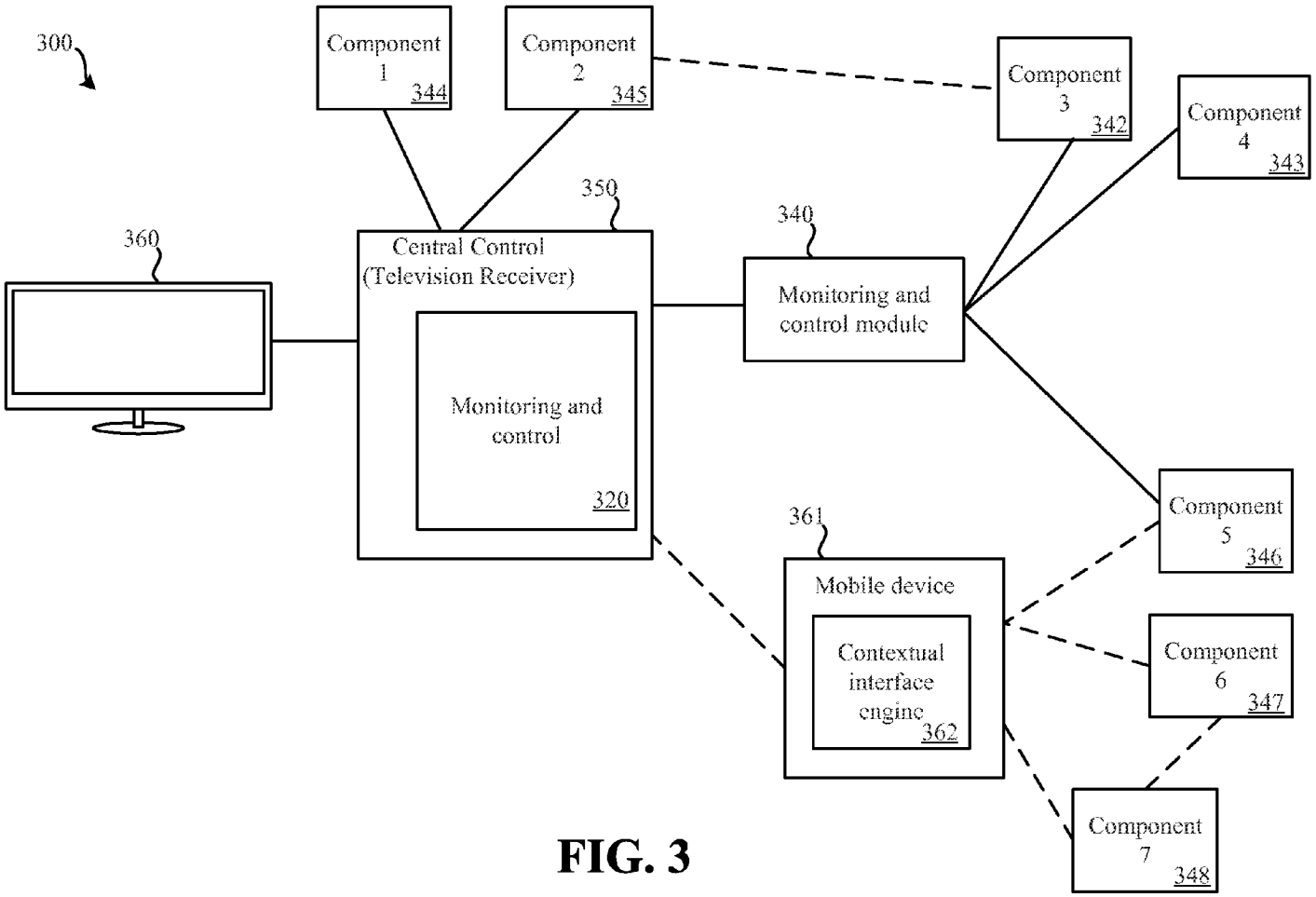
FIG. 3 illustrates an embodiment of a home monitoring and control system.

FIG. 3 shows an embodiment of a system 300 for home monitoring and control. The system 300, may include various components 342, 343, 344, 345, 346, 347, 348 that may include sensing and/or control functionalities. The components 342, 343, 344, 345, 346, 347, 348 may be spread throughout a home or a property. Some components 342, 345 may be directly connected to a central control 350. Some components 342, 343, 346 may connect to a central control 350 via separate control and monitoring modules 340. Other components 347, 348 may be independent from a central control 350.

A central control 350 in a home may provide for a control interface to monitor/control one or more of the components. In some embodiments, the central control 350 may be a television receiver. The television receiver may be communicatively coupled to receive readings from one or more components that may be sensors or control modules of the system.

Television receivers such as set-top boxes, satellite based television systems, and/or the like are often centrally located within a home. Television receivers are often interconnected to remote service providers, have wired or wireless interconnectivity with mobile devices, provide a familiar interface and are associated or connected with a large display that may be used displaying status and control functions.

Television receivers may be configured to receive information from sensors, telemetry equipment, and other systems in a home. Capabilities of the television receivers may be utilized to analyze sensor and telemetry readings, receive user input or configurations, provide visual representations and analysis of sensor readings and the like. For example, the processing and data storage capabilities of the television receivers may be used to analyze and process sensor readings. The sensor readings may be stored on the data storage of the receiver providing historical data for analysis and interpretation.

A central control 350 may include a monitoring and control module 320 and may be directly connected or coupled to one or more components. Components may be wired or wirelessly coupled to the central control 350. Components may be connected in a serial, parallel, star, hierarchical, and/or the like topologies and may communicate to the central control via one or more serial, bus, or wireless protocols and technologies which may include, for example, WiFi, CAN bus, Bluetooth, I2C bus, ZigBee, Z-Wave and/or the like.

In some embodiments, the system may include one or more monitoring and control modules 340 that are external to the central control 350. In embodiments the central control may interface to components via one or more monitoring and control modules 340.

Components of the system may include sensors. The sensors may include any number of temperate, humidity, sound, proximity, field, electromagnetic, magnetic sensors, cameras, infrared detectors, motion sensors, pressure sensors, smoke sensors, fire sensors, water sensors, and/or the like. Components of the system may include control units. The control units may include any number of switches, solenoids, solid state devices and/or the like for making noise, turning on/off electronics, heating and cooling elements, controlling appliances, HVAC systems, lights, and/or the like. For example, a control unit may be a device that plugs in to an electrical outlet of a home. Other devices, such as an appliance, may be plugged into the device. The device may be controlled remotely to enable or disable electricity to flow to the appliance.

In embodiments, sensors may be part of other devices and/or systems. For example, temperature sensors may be part of a heating and ventilation system of a home. The readings of the sensors may be accessed via a communication interface of the heating and ventilation system. Control units may also be part of other devices and/or systems. A control unit may be part of an appliance, heating or cooling system, and/or other electric or electronic device. In embodiments the control units of other system may be controlled via a communication or control interface of the system. For example, the water heater temperature setting may be configurable and/or controlled via a communication interface of the water heater or home furnace. Sensors and/or control units may be combined into assemblies or units with multiple sensing capabilities and/or control capabilities. A single module may include, for example a temperature sensor and humidity sensor. Another module may include a light sensor and power or control unit and so on.

Components such as sensors and control units may be configurable or adjustable. In some cases the sensors and control units may be configurable or adjustable for specific applications. The sensors and control units may be adjustable by mechanical or manual means. In some cases the sensors and control units may be electronically adjustable from commands or instructions sent to the sensors or control units.

In embodiments, the results, status, analysis, and configuration data details for each component may be communicated to a user. In embodiments auditory, visual, and tactile communication methods may be used. In some cases a display device such as a television 360 may be used for display and audio purposes. The display device may show information related to the monitoring and control application. Statistics, status, configuration data, and other elements may be shown.

In embodiments the system may include additional notification and display devices such as a mobile device 361 capable of notifying the user, showing the status, configuration data, and/or the like. The additional notification and display devices may be devices that directly or indirectly connected to the central control 350. In some embodiments computers, mobile devices, phones, tablets, and the like may receive information, notifications, from the central control 350. Data related to the monitoring and control applications and activity may be transmitted to mobile devices and displayed to a user via the central control or directly from components.

A mobile device 361 may present to the user, interfaces that may be used to configure or monitor or interact with system components. An interface may include one or more options, selection tools, navigation tools for modifying the configuration data which in turn may change monitoring and/or control activity of components.

A contextual interface engine 362 of a mobile device 361 may be used to detect control markers that may trigger the display of specific interfaces for the control or monitoring of components that may be associated with the control marker. Depending on the component or configuration of the system 300, the mobile device may transmit and/or receive data and commands related to the component directly from each component or via a central control 350. In some configurations, the central control may provide a uniform interface for various components.

Figure 4:
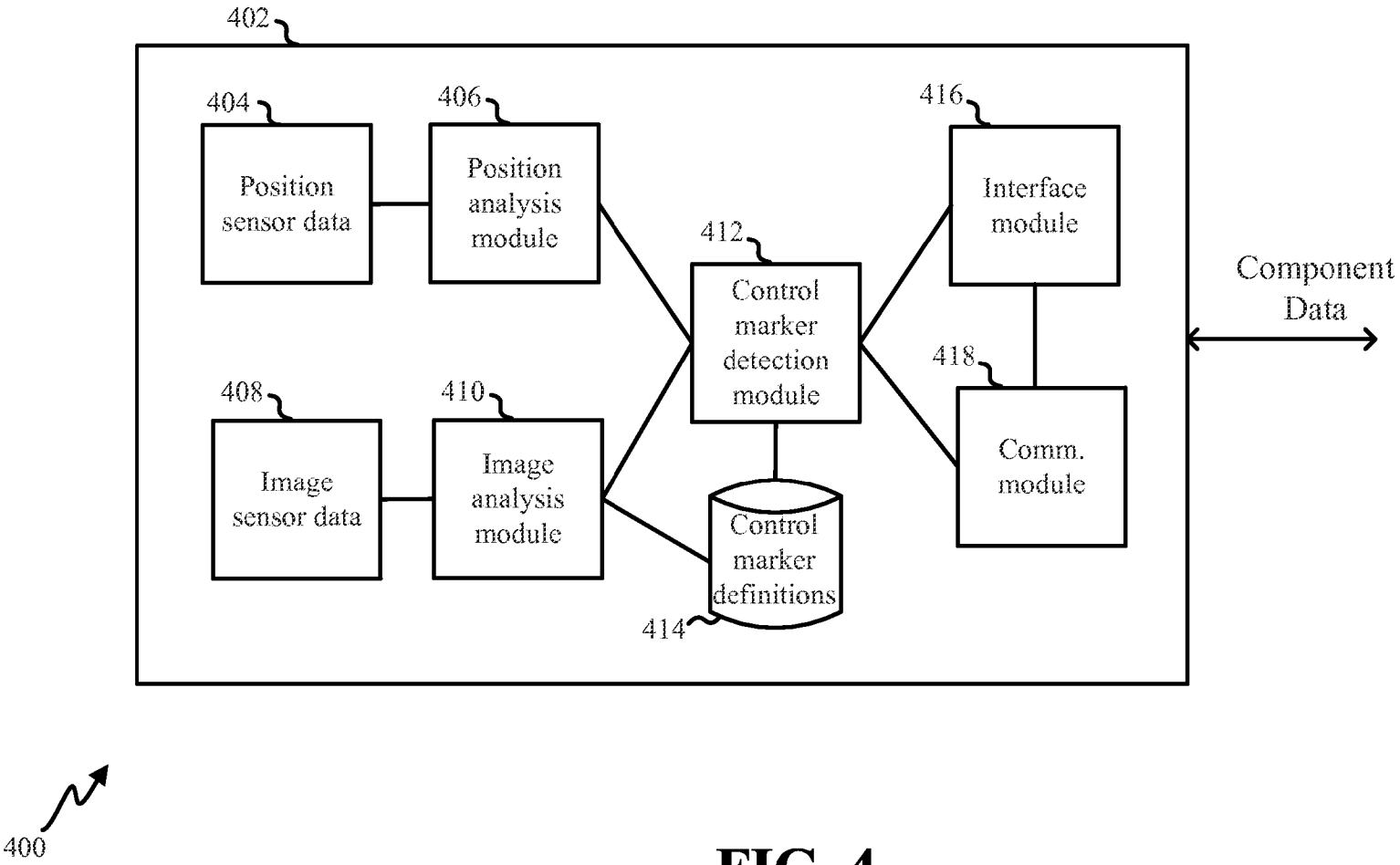
FIG. 4 illustrates an embodiment of a contextual interface engine.

FIG. 4 illustrates an embodiment of a contextual interface engine 400. Contextual interface engine 400 represents an embodiment of contextual interface engine 362 of FIG. 3. Contextual interface engine 400 is illustrated as being composed of multiple components. It should be understood that contextual interface engine 400 may be broken into a greater number of components or collapsed into fewer components. Each component of the contextual interface engine 400 may include computerized hardware, software, and/or firmware. In some embodiments, contextual interface engine 400 is implemented as software that is executed by a processor of the mobile device 361 of FIG. 3. Contextual interface engine 400 may include a position analysis module 406 that receives position sensor data 404, an image analysis module 410 that received image sensor data 408. The contextual interface engine 400 may also include a control marker detection module 412 and control marker definitions 414 as well as an interface module 416 and a communication module 418.

The contextual interface engine 400 may analyze sensor data to determine if a mobile device is being pointed at or is in proximity to a control marker. Based on the identified control marker, the contextual interface engine 400 may determine the component(s) associated with the control marker and provide an interface for the component. The contextual interface engine may access sensor data such as position sensor data 404 or image sensor data 408 of a mobile device or from an external source. The position sensor data 404, for example, may be received from a position tracking system in a home that tracks the location of a user or a mobile device. Sensor data may also originate from cameras, infrared sensors, accelerometers, compass, lasers, and the like that may be part of a mobile device. In some embodiments, only one of position sensor data or image sensor data may be available.

Image sensor data 408 may be processed and analyzed by the image analysis module 410. The image analysis module 410 may be configured to analyze image data and identify possible control markers. The image analysis module may use image recognition algorithms to identify features of the image. The image analysis module may perform multiple passes of analysis to identify different types of control markers. In the first pass, the image analysis module 410 may be configured to identify computer readable barcodes or other computer readable identifiers. In subsequent passes the image analysis module may identify objects or shapes that may be control markers. The image analysis module 410 may receive control marker definitions from the control marker definitions database 414. The definitions may include characteristics of markers that may be used for image analysis. The image analysis module 410 may compare the definitions against features identified in the image to determine if any of the definitions are consistent with the image.

Position sensor data 404 may be processed and analyzed by the position analysis module 406. Position data that may include location and/or orientation of the mobile device. The position data may be analyzed by the position analysis module 406 to map the position data to specific area of a home. The position analysis module may use the location and orientation data to determine specific areas of a home that a mobile device is pointing at.

The control marker detection module 412 may use the analysis of the position analysis module 406 and/or the image analysis module 410 to identify control markers that may be in close proximity or that may be pointed at by the mobile device. The control marker detection module may refine the identified control markers from the image analysis module 410 using the position data from the position analysis module 406. Control markers that are not consistent with the position of the mobile device may be filtered or ignored. Data associated with the control markers that are identified to be consistent with the image sensor data and the position may be loaded from the control marker definitions database 414 or from an external source. The data may include information about the component(s) associated with the control markers, the capabilities of the components, authorization required for the components, communication protocols, user interface data, and the like. The control marker detection module 412 may be configured to further determine that of the user or mobile device is compatible and/or authorized to interact with the component(s) associated with the control markers.

Based on the identified control markers by the control marker detection module 412, the interface module 416 may be configured to provide an interface that may be displayed by the mobile device for displaying data related to the components associated with the control markers. In some cases the interface may be configured to receive input from a user to adjust the operating characteristics or settings of the component. The communication module 418 may establish communication with the component(s). The communication may be direct with each component or via other components or central control. Component data received by the communication module 418 may be displayed on the user interface.

Figure 5:
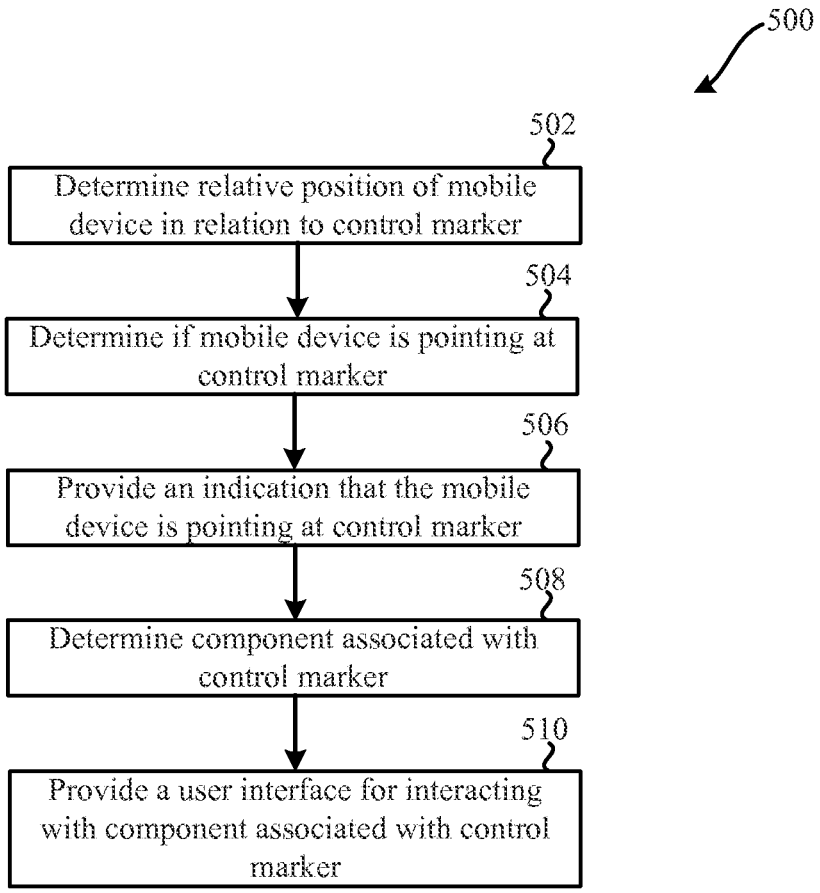
FIG. 5 illustrates an embodiment of a method for automation control using a mobile device.

Various methods may be performed using system 300 of FIG. 3 and the contextual interface engine 400 of FIG. 4. FIG. 5 illustrates an embodiment of a method 500 for performing automation control using a mobile device. Each step of method 500 may be performed by a computer system, such as computer system 900 of FIG. 9. Means for performing the method 500 can include one or more computing devices functioning in concert, such as in a distributed computing arrangement.

At step 502 the relative position of a mobile device in relation to a control marker may be determined. Data from sensors of the mobile device or from external systems may be used to determine the location and/or orientation of a mobile device. Data related to the position of known control markers may be compared to the position of the mobile device to determine their relative locations. In some cases, location markers may be detected and used to determine the location. At step 504, a determination may be made if the mobile device is pointing at a control marker. The relative positions and orientations of the mobile device and the control markers may be analyzed for the determination. In some cases, additional data may be used to verify that the mobile device is pointing at the control marker. Images from a camera or other sensors may be captured and used to determine the relative locations of the mobile device and the control markers.

At step 506, an indication may be generated that that the mobile device is pointing at a control marker. The indication may include a visual, auditory, and/or tactile indication. At step 508, the component(s) associated with the control marker may be determined. A mobile device may query one or more internal or external databases or resources to determine the capabilities, available settings, user preferences, and the like that are related to the component(s). At step 510 a user interface may be provided to the user that is configured for the component(s) associated with the control marker that the mobile device is pointing at. The user interface may present information related to the component such current settings, sensor readings, and the like. The user interface may present controls for modifying settings of the component.

Figure 6:
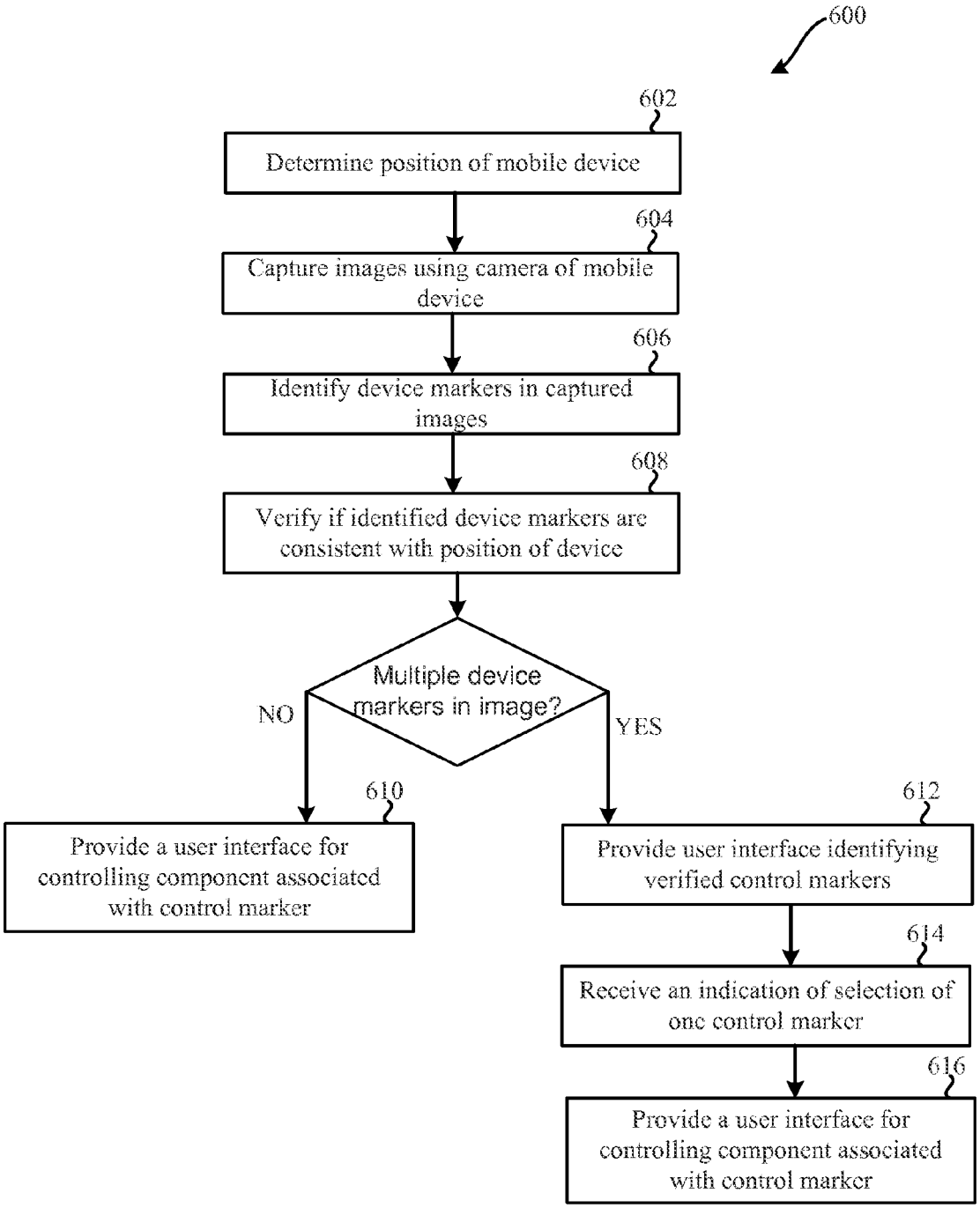
FIG. 6 illustrates another embodiment of a method for automation control using a mobile device.

FIG. 6 illustrates an embodiment of another method 600 for performing automation control using a mobile device. Each step of method 600 may be performed by a computer system, such as computer system 900 of FIG. 9. Means for performing the method 600 can include one or more computing devices functioning in concert, such as in a distributed computing arrangement.

At step 602 the position of a mobile device may be determined. Data from sensors of the mobile device or from external systems may be used to determine the position and/or orientation of a mobile device. At step 604, images or video from a camera of the mobile device may be captured. The images and/or video may be analyzed to identify control markers. At step 606 the identified control markers may be compared with the locations of known control markers to determine if the identified control markers are consistent with the position of the mobile device. If one or more identified control marker are not consistent with the position of the mobile device the images and/or the position of the mobile device may be further refined by analyzing sensor readings.

If only one control marker is identified, at step 610, the mobile device may present to a user a user interface for a component associated with the control marker. If more than one control marker is identified, at step 612, the mobile device may present a user interface that shows all the identified control markers and optionally the components associated with each control marker. The user interface may allow the user to select one of the control markers. After an indication of a selection of one control marker is received from the user in step 614, the mobile device may be configured to provide an interface for a component associated with the selected control marker.

Figure 7:
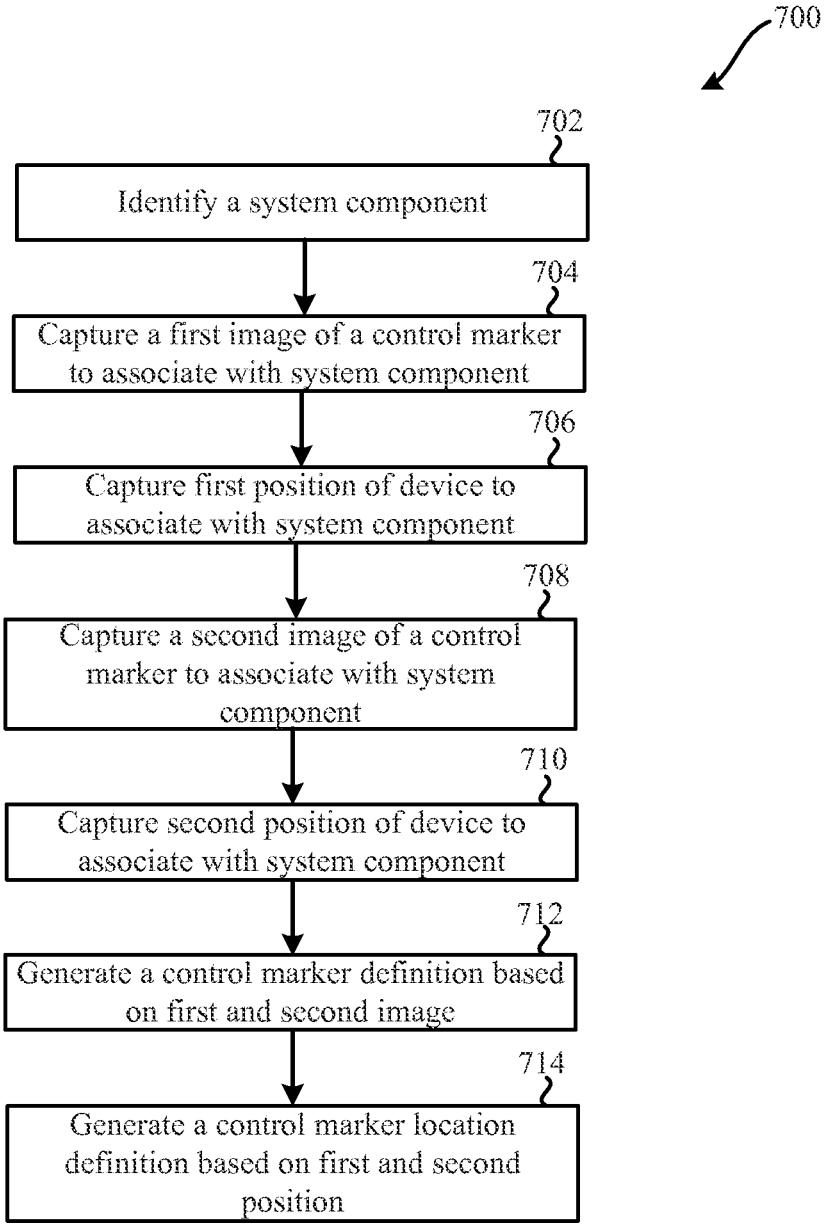
FIG. 7 illustrates an embodiment of a method for training a mobile device for automation control.

FIG. 7 illustrates an embodiment of a method 700 for training a mobile device for automation control. Each step of method 700 may be performed by a computer system, such as computer system 900 of FIG. 9. Means for performing the method 700 can include one or more computing devices functioning in concert, such as in a distributed computing arrangement. The method may be used to train a mobile device to detect a user specified control marker. The control marker may be associated with a component that may then be controlled by the mobile device.

At step 702 a component of a home automation system may be identified. The component may be selected from the mobile device. The mobile device may be used to search of a wireless signal for components. The mobile device may provide a list of available components that may be associated with a control marker. The mobile device may also query a central control to identify components. An object in a home may be selected as a control marker for the component. When the a mobile device is pointing at the object an interface for the component may be provided on the mobile device. To capture and define the control marker the mobile device may be used to capture an image of the object that is designated as the control marker in step 704. The camera of the mobile device may be used to capture a picture or a video clip of the the object. At the same time or around the same time as the image of video of the object is captured, the mobile device may also capture the position information of the device in step 706. The position information and the image may be associated with each other. The capturing of the image and the position may be performed from a location that a user would normally try to detect the control marker.

Additional images and position information may be captured of the object using the mobile device in steps 708 and 710. The additional images and position information may be captured from different angles, different positions, in different lighting conditions, and the like. The captured images of the object may be analyzed to identify shapes, or definitions that may be later used to identify the marker. In some cases, the user may identify a specific area of an image that includes the object to be used as the control marker. In some embodiments, the images may include machine readable markers such as barcodes, codes, shapes, or the like that may be positioned on an object during image capture that will facilitate object detection.

The captured position information may be associated with the control marker definitions. The position information may be combined to provide a zone or range of valid mobile device positions in step 714. The position information and the image definitions may be used to identify a control marker during system operation.

Figure 8:
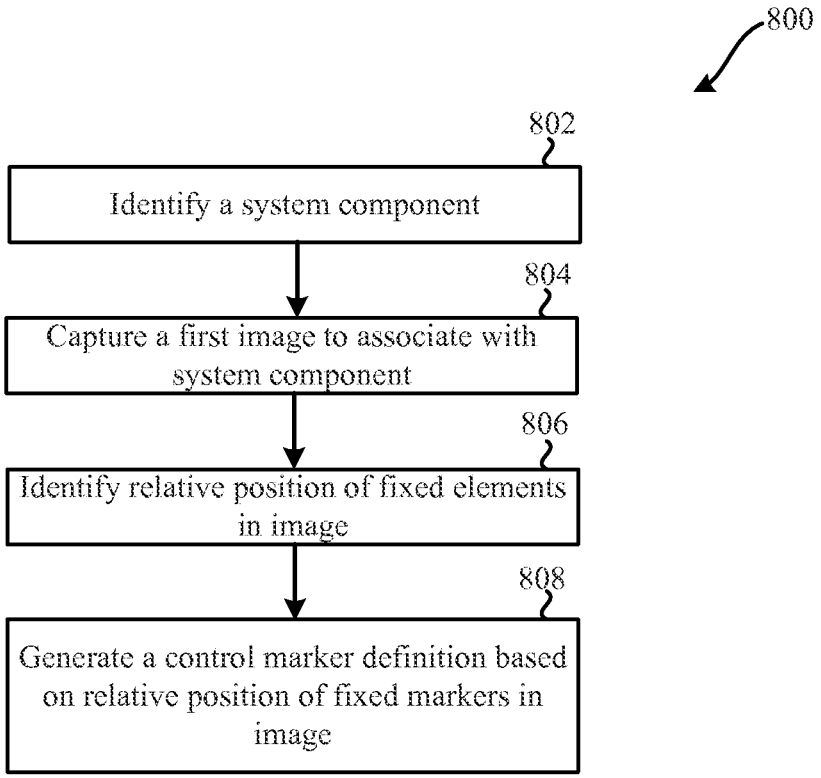
FIG. 8 illustrates an embodiment of a method for training a mobile device for automation control.

FIG. 8 illustrates an embodiment of a second method 800 for training a mobile device for automation control. Each step of method 800 may be performed by a computer system, such as computer system 900 of FIG. 9. Means for performing the method 800 can include one or more computing devices functioning in concert, such as in a distributed computing arrangement.

At step 802 a component of a home automation system may be identified. The component may be selected from the mobile device. In embodiments a control marker may be created by positioning elements that may be easily detectable by a camera. Elements may be for example, stickers or colored stamps with shapes such as circles, triangles, or other shapes. The elements may be not visible by a human eye but only visible by a camera due to their color, for example. One or more elements may be positioned to create a control marker. The control marker may be defined by the number of elements, types of elements, relative orientation of the elements, and the like. A camera of the mobile device may be used to capture an image of the elements at step 804. At step 806 the relative position, the types of elements, the number of elements in the image may be analyzed to generate a control marker definition in step 808.

It should be understood that although the methods and examples described herein used a home automation system other environments may also benefit from the methods and systems described. A mobile device may be used to provide contextual menus for interacting with components in industrial settings for example. The status of sensors, machines, structures, or systems may be updated or controlled in a factory or warehouse with a mobile device. The menus and interfaces of the mobile device may change depending on the objects or control markers the mobile device is pointing at.

Figure 9:
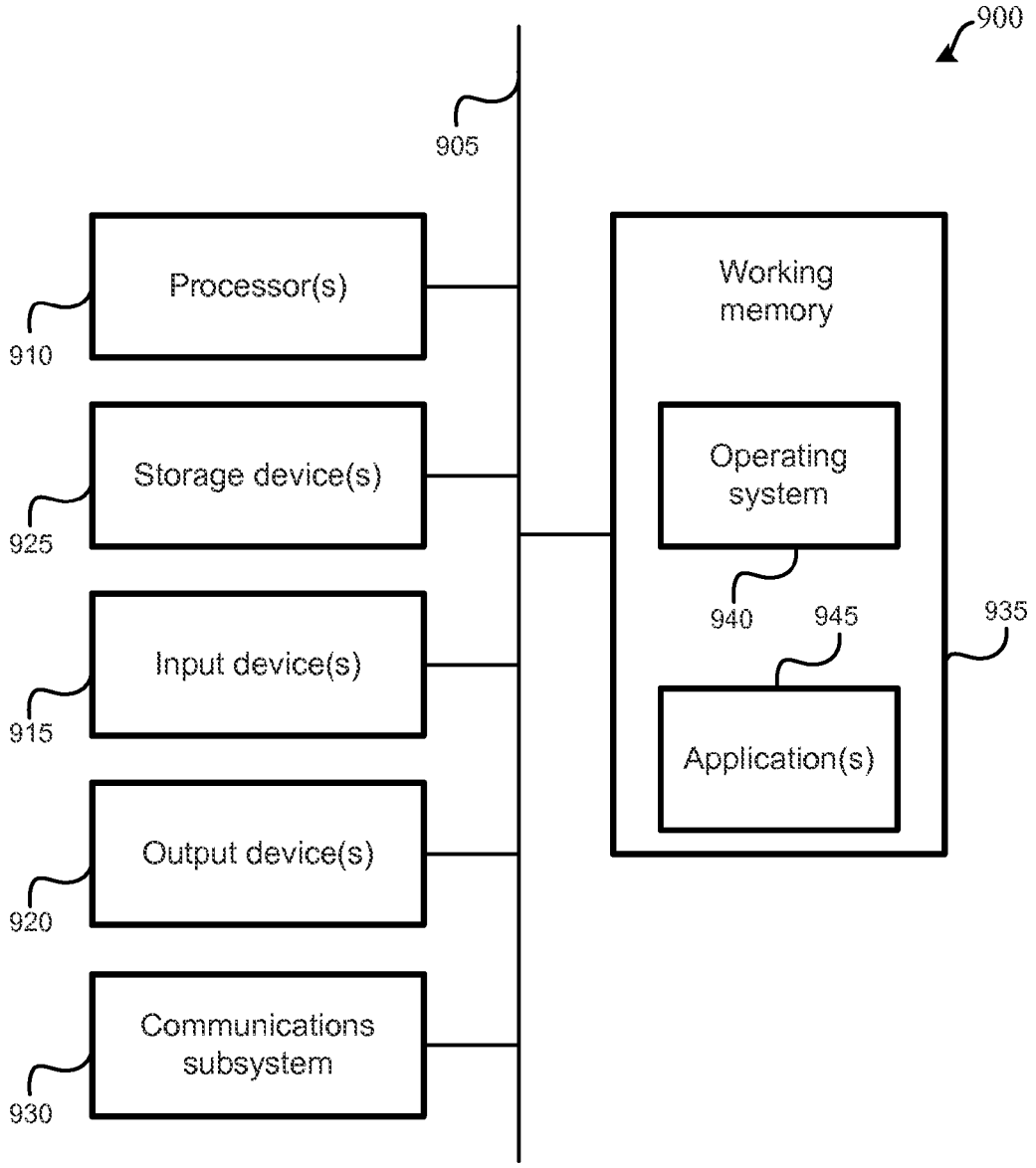
FIG. 9 illustrates an embodiment of a computer system.

A computer system as illustrated in FIG. 9 may be incorporated as part of the previously described computerized devices, such as the described mobile devices and home automation systems. FIG. 9 provides a schematic illustration of one embodiment of a computer system 900 that can perform various steps of the methods provided by various embodiments. It should be noted that FIG. 9 is meant only to provide a generalized illustration of various components, any or all of which may be utilized as appropriate. FIG. 9, therefore, broadly illustrates how individual system elements may be implemented in a relatively separated or relatively more integrated manner.

The computer system 900 is shown comprising hardware elements that can be electrically coupled via a bus 905 (or may otherwise be in communication, as appropriate). The hardware elements may include one or more processors 910, including without limitation one or more general-purpose processors and/or one or more special-purpose processors (such as digital signal processing chips, graphics acceleration processors, video decoders, and/or the like); one or more input devices 915, which can include without limitation a mouse, a keyboard, remote control, and/or the like; and one or more output devices 920, which can include without limitation a display device, a printer, and/or the like.

The computer system 900 may further include (and/or be in communication with) one or more non-transitory storage devices 925, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable and/or the like. Such storage devices may be configured to implement any appropriate data stores, including without limitation, various file systems, database structures, and/or the like.

The computer system 900 might also include a communications subsystem 930, which can include without limitation a modem, a network card (wireless or wired), an infrared communication device, a wireless communication device, and/or a chipset (such as a Bluetooth™ device, an 802.11 device, a WiFi device, a WiMax device, cellular communication device, etc.), and/or the like. The communications subsystem 930 may permit data to be exchanged with a network (such as the network described below, to name one example), other computer systems, and/or any other devices described herein. In many embodiments, the computer system 900 will further comprise a working memory 935, which can include a RAM or ROM device, as described above.

The computer system 900 also can comprise software elements, shown as being currently located within the working memory 935, including an operating system 940, device drivers, executable libraries, and/or other code, such as one or more application programs 945, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be stored on a non-transitory computer-readable storage medium, such as the non-transitory storage device(s) 925 described above. In some cases, the storage medium might be incorporated within a computer system, such as computer system 900. In other embodiments, the storage medium might be separate from a computer system (e.g., a removable medium, such as a compact disc), and/or provided in an installation package, such that the storage medium can be used to program, configure, and/or adapt a general purpose computer with the instructions/code stored thereon. These instructions might take the form of executable code, which is executable by the computer system 900 and/or might take the form of source and/or installable code, which, upon compilation and/or installation on the computer system 900 (e.g., using any of a variety of generally available compilers, installation programs, compression/decompression utilities, etc.), then takes the form of executable code.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 900) to perform methods in accordance with various embodiments of the invention. According to a set of embodiments, some or all of the procedures of such methods are performed by the computer system 900 in response to processor 910 executing one or more sequences of one or more instructions (which might be incorporated into the operating system 940 and/or other code, such as an application program 945) contained in the working memory 935. Such instructions may be read into the working memory 935 from another computer-readable medium, such as one or more of the non-transitory storage device(s) 925. Merely by way of example, execution of the sequences of instructions contained in the working memory 935 might cause the processor(s) 910 to perform one or more procedures of the methods described herein.

The terms "machine-readable medium," "computer-readable storage medium" and "computer-readable medium," as used herein, refer to any medium that participates in providing data that causes a machine to operate in a specific fashion. These mediums may be non-transitory. In an embodiment implemented using the computer system 900, various computer-readable media might be involved in providing instructions/code to processor(s) 910 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the non-transitory storage device(s) 925. Volatile media include, without limitation, dynamic memory, such as the working memory 935.

Common forms of physical and/or tangible computer-readable media include, for example, a floppy disk, a flexible disk, hard disk, magnetic tape, or any other magnetic medium, a CD-ROM, any other optical medium, any other physical medium with patterns of marks, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 910 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 900.

The communications subsystem 930 (and/or components thereof) generally will receive signals, and the bus 905 then might carry the signals (and/or the data, instructions, etc. carried by the signals) to the working memory 935, from which the processor(s) 910 retrieves and executes the instructions. The instructions received by the working memory 935 may optionally be stored on a non-transitory storage device 925 either before or after execution by the processor(s) 910.

It should further be understood that the components of computer system 900 can be distributed across a network. For example, some processing may be performed in one location using a first processor while other processing may be performed by another processor remote from the first processor. Other components of computer system 900 may be similarly distributed. As such, computer system 900 may be interpreted as a distributed computing system that performs processing in multiple locations. In some instances, computer system 900 may be interpreted as a single computing device, such as a distinct laptop, desktop computer, or the like, depending on the context.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. A method for automation control using a mobile device, comprising:

receiving, using an input interface, input corresponding to selection of a remote controlled home automation device;

capturing, using an image sensor, an image of a house-hold object to designate as a control marker for the remote controlled home automation device;

capturing, using a position sensor, a position of the mobile device to associate with control marker;

generating a template for the control marker using the position and the image;

determining a relative position of the mobile device in relation to the house-hold object designated as a control marker for the remote controlled home automation device;

capturing, using the image sensor, a second image of the house-hold object;

determining that the mobile device is pointing at the control marker by analyzing the second image, the relative position, and the template;

providing an indication that the mobile device is pointing at the control marker;

determining a user interface for the remote controlled home automation device; and providing the user interface on the mobile device for interacting with the remote controlled home automation device;

wherein the user interface includes features specific to the remote controlled home automation device.

2. The method of claim 1, further comprising:

establishing a communication channel with the remote controlled home automation device;

receiving, via the communication channel, data related to a state of the remote controlled home automation device; and transmitting, via the communication channel, a control command to the remote controlled home automation device.

3. The method of claim 1, further comprising:

determining a change in the relative position of the mobile device;

determining that the mobile device is pointing at a second control marker associated with a second remote controlled home automation device; and modifying the user interface on the mobile device for interacting with the second remote controlled home automation device associated with the second control marker.

4. The method of claim 1, wherein position includes an orientation and a location of the mobile device.

5. The method of claim 1, further comprising:

receiving input corresponding to selection of a custom interface design including one or more features specific to the remote controlled home automation device to include in the user interface; and modifying the user interface to include the custom interface design.

6. The method of claim 5, wherein the custom interface design includes a subset of available features specific to the remote controlled home automation device.

7. The method of claim 1, wherein determining the relative position of the mobile device comprises:

receiving data from a sensor attached to the mobile device; and tracking movement of the mobile device by analyzing changes in data from the sensor.

8. A non-transitory processor-readable medium for automation control using a mobile device, the medium comprising processor-readable instructions that, when executed by one or more processors, cause the one or more processors to perform operations including:

receiving, using an input interface, input corresponding to selection of a remote controlled home automation device;

capturing, using an image sensor, an image of a household object to designate as a control marker for the remote controlled home automation device;

capturing, using a position sensor, a position of the mobile device to associate with control marker;

generating a template for the control marker using the position and the image;

determining a relative position of the mobile device in relation to the house-hold object designated as a control marker for the remote controlled home automation device;

capturing, using the image sensor, a second image of the house-hold object;

determining that the mobile device is pointing at the control marker by analyzing the second image, the relative position, and the template;

providing an indication that the mobile device is pointing at the control marker;

determining a user interface for the remote controlled home automation device; and providing the user interface on the mobile device for interacting with the remote controlled home automation device;

wherein the user interface includes features specific to the remote controlled home automation device.

9. The non-transitory processor-readable medium of claim 8, wherein the operations further include:

establishing a communication channel with the remote controlled home automation device;

receiving, via the communication channel, data related to a state of the remote controlled home automation device; and transmitting, via the communication channel, a control command to the remote controlled home automation device.

10. The non-transitory processor-readable medium of claim 8, wherein the operations further include:

determining a change in the relative position of the mobile device;

determining that the mobile device is pointing at a second control marker associated with a second remote controlled home automation device; and modifying the user interface on the mobile device for interacting with the second remote controlled home automation device associated with the second control marker.

11. The non-transitory processor-readable medium of claim 8, wherein position includes an orientation and a location of the mobile device.

12. The non-transitory processor-readable medium of claim 8, wherein the operations further include:

receiving input corresponding to selection of a custom interface design including one or more features specific to the remote controlled home automation device to include in the user interface; and modifying the user interface to include the custom interface design.

13. The non-transitory processor-readable medium of claim 12, wherein the custom interface design includes a subset of available features specific to the remote controlled home automation device.

14. The non-transitory processor-readable medium of claim 8, wherein determining the relative position of the mobile device comprises:

receiving data from a sensor attached to the mobile device; and tracking movement of the mobile device by analyzing changes in data from the sensor.

15. A mobile device configured for automation control, comprising:

one or more processors;

a memory communicatively coupled with and readable by the one or more processors and having stored therein processor-readable instructions that, when executed by the one or more processors, cause the one or more processors to perform operations including:

receiving, using an input interface, input corresponding to selection of a remote controlled home automation device;

capturing, using an image sensor, an image of a household object to designate as a control marker for the remote controlled home automation device;

capturing, using a position sensor, a position of the mobile device to associate with the control marker;

generating a template for the control marker using the position and the image; determining a relative position of the mobile device in relation to the household object designated as a control marker for the remote controlled home automation device;

capturing, using the image sensor, a second image of the house-hold object; determining that the mobile device is pointing at the control marker by analyzing the second image, the relative position, and the template; providing an indication that the mobile device is pointing at the control marker; and determining a user interface for the remote controlled home automation device; and providing the user interface on the mobile device for interacting with the remote controlled home automation device;

wherein the user interface includes features specific to the remote controlled home automation device.

16. The mobile device of claim 15, wherein the operations further include:

establishing a communication channel with the remote controlled home automation device;

receiving, via the communication channel, data related to a state of the remote controlled home automation device; and transmitting, via the communication channel, a control command to the remote controlled home automation device.

17. The mobile device of claim 15, wherein the operations further include:

determining a change in the relative position of the mobile device;

determining that the mobile device is pointing at a second control marker associated with a second remote controlled home automation device; and modifying the user interface on the mobile device for interacting with the second remote controlled home automation device associated with the second control marker.

18. The mobile device of claim 15, wherein position includes an orientation and a location of the mobile device.

19. The mobile device of claim 15, wherein the operations further include:

receiving input corresponding to selection of a custom interface design including one or more features specific to the remote controlled home automation device to include in the user interface; and modifying the user interface to include the custom interface design.

20. The mobile device of claim 19, wherein the custom interface design includes a subset of available features specific to the remote controlled home automation device.

* * * * *